US006529096B2

(12) United States Patent
Maekawa et al.

(10) Patent No.: US 6,529,096 B2
(45) Date of Patent: Mar. 4, 2003

(54) DIELECTRIC FILTER, ANTENNA DUPLEXER, AND COMMUNICATIONS APPLIANCE

(75) Inventors: Tomoya Maekawa, Katano (JP); Hiroshi Kushitani, Izumisano (JP); Hiroshi Shigemura, Kyotanabe (JP); Toru Yamada, Katano (JP); Toshio Ishizaki, Kobe (JP); Hideaki Nakakubo, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/748,110

(22) Filed: Dec. 27, 2000

(65) Prior Publication Data

US 2001/0050599 A1 Dec. 13, 2001

(30) Foreign Application Priority Data

May 30, 2000 (JP) ..... 2000-159521
Jun. 28, 2000 (JP) ..... 2000-193815

(51) Int. Cl.[7] ..... H01P 1/213; H01P 1/203

(52) U.S. Cl. ..... 333/134; 333/204

(58) Field of Search ..... 333/134, 204

(56) References Cited

U.S. PATENT DOCUMENTS 5,396,201 A * 3/1995 Ishizaki et al. ..... 333/204
5,412,358 A * 5/1995 Hirai et al. ..... 333/204

FOREIGN PATENT DOCUMENTS

EP 0 837 517 4/1998
JP 10-178302 6/1998

* cited by examiner

*Primary Examiner*—Robert Pascal
*Assistant Examiner*—Joseph Chang
(74) *Attorney, Agent, or Firm*—Smith, Gambrell & Russell, LLP

(57) ABSTRACT

A dielectric filter including a plurality of resonators, and at least one transmission line provided among said plurality of resonators. A band rejection characteristic is formed around a resonance frequency of the resonator, and a line length of the transmission line is shorter than ¼ of a wavelength corresponding to the resonance frequency of the resonator.

5 Claims, 36 Drawing Sheets

$f_0$=2.0GHz $\varepsilon_r$=58 Guide wavelength=19.7mm $f_0$=2GHz, $\varepsilon_r$=58 ⇨ $\lambda g$ (Guide wavelength) =19.7mm Transmission line length =4.8mm=0.244 λg Dataset=DATASET Qualifier=

$f_0$=2GHz, $\varepsilon_r$=1.8 ⇨ λg (Guide wavelength) ≒112mm $f_0$=2GHz, $\varepsilon_r$=44 ⇨ $\lambda g$ (Guide wavelength) =22.6mm Transmission line length =5.1mm⇒0.259 λg $f_0$=2GHz, $\varepsilon_r$=58 ⇨ $\lambda g$ (Guide wavelength) =19.7mm

S11

S22

DIELECTRIC FILTER, ANTENNA DUPLEXER, AND COMMUNICATIONS APPLIANCE

BACKGROUND OF THE INVENTION

1. Field of the Invention

The present invention relates to a small dielectric filter used for a high frequency radio appliance such as a portable telephone, etc., a dielectric filter which has strip line type resonator electrodes on a dielectric substrate, and connects them in electromagnetic field, a antenna duplexer, etc.

2. Related Art of the Invention

Recently, dielectric filters have been widely used as high frequency filters of portable telephones, etc., and have been requested to be smaller and thinner. Under the situation, a laminated dielectric filter which can be thinner than a coaxial type filter is expected to have a higher market share.

An example of the conventional laminated dielectric filter is described below by referring to the attached drawings.

FIG. 32 is an analytic oblique view of the structure of a conventional dielectric filter.

FIG. 33 shows an equivalent circuit of the dielectric filter shown in FIG. 32.

In FIG. 32, the dielectric filter is a structure including: dielectric layers 3401, 3402, 3403, 3404, and 3405; resonator electrodes 3406*a* and 3406*b*, transmission line electrodes 3407*a*, 2307*b*, and 3407*c* having input/output terminals on both ends; notch capacity electrodes 3408*a* and 3408*b*: and shield electrodes 3409 and 3410. These internal electrodes are formed between each dielectric layers.

As shown in FIG. 33, the dielectric filter forming the band rejection characteristic around the resonance frequency of the resonator includes resonators 3501*a* and 3501*b*, and transmission lines 3502*a*, 3502*b*, and 3502*c* connected through capacitors 3503*a* and 3503*b*. The capacitors 3503*a* and 3503*b* are respectively connected in series to the resonators 3501*a* and 3501*b*. Therefore, they functions as attenuation poles indicating high attenuation amounts around the resonance frequency of the resonators 3501*a* and 3501*b*.

Normally, in the filter theory, the line length of the transmission line 3502*c* is set equal to ¼ of the wavelength corresponding the resonance frequency of the resonators 3501*a* and 3501*b* so that a filter can be configured with the infinite impedance of the transmission line electrode 3502*c*, and the band rejection characteristic formed around the resonance frequency of the resonators 3501*a* and 3501*b*.

FIG. 34 also shows an equivalent circuit of a filter forming a band rejection characteristic around the resonance frequency of a resonator. As shown in FIG. 34, the filter forming a band rejection characteristic around the resonance frequency of a resonator includes a transmission line having input/output terminals at both ends, a capacitor, and a resonator. A transmission line 4501 is connected to a resonator 4503 through a capacitor 4502.

Since the capacitor 4502 is serially connected to the resonator 4503, it functions as an attenuation pole indicating a high attenuation amount around the resonance frequency of the resonator 4503. In common filter designing, it is normal that input/output terminals at both ends have the same impedance values. Therefore, the values of elements forming a filter circuit are symmetrically designed.

However, to actually realize the configuration as shown in FIG. 32 as a dielectric filter, the long line of the transmission line electrode, which is a primary line of the filter, does not allow the transmission line having the length of ¼ of the wavelength corresponding to the resonance frequency of the resonator to function as is on a dielectric layer which has a finite space. Therefore, wiring pattern of the transmission line can't be formed straight, that is, the pattern becomes inevitably zigzag, and the width of the transmission line is reduced so that it can be designed on a dielectric layer or in a dielectric. The above mentioned configuration of a transmission line has the problem that it incurs the deterioration due to a loss in the pass band frequency of a dielectric filter forming the band rejection characteristic around the resonance frequency of the resonator.

With the configuration shown in FIG. 34, a filter forming a band rejection characteristic around the resonance frequency of a resonator can include attenuation poles equal in number to the resonators forming the filter. However, when the values of attenuation pole forming capacitors are equal, the positions of the plurality of attenuation poles are the same. Therefore, as shown in FIG. 36, there has been the problem that the rejection band is necessarily narrow. FIG. 35 is a Smith chart showing the state. Furthermore, when the above mentioned filter is used for one or both of the transmission filter and the reception filter of an antenna duplexer, the terminals connected at both ends of the transmission lines have different impedance values. Therefore, when the above mentioned filter is used for a antenna duplexer, there has been the problem that a filter characteristic has distortion, etc.

SUMMARY OF THE INVENTION

The present invention has been developed to solve the above mentioned problem, and aims at providing a small and thin laminated dielectric filter forming a band rejection characteristic around the resonance frequency of a resonator, and having a low loss characteristic at a desired frequency.

Furthermore, the present invention aims at realizing a filter having an excellent band rejection characteristic around the resonance frequency of a resonator with a simple configuration, and providing a filter having an excellent characteristic as a transmission filter and a reception filter of a antenna duplexer.

The $1^{st}$ invention of the present invention is a dielectric filter, comprising:

a plurality of resonators; and at least one transmission line provided among said plurality of resonators, wherein a band rejection characteristic is formed around a resonance frequency of said resonator, and a line length of said transmission line is shorter than ¼ of a wavelength corresponding to the resonance frequency of said resonator.

The $2^{nd}$ invention-of the present invention is the dielectric filter according to $1^{st}$ invention, wherein said plurality of resonators are coupled in electromagnetic field.

The $3^{rd}$ invention of the present invention is the dielectric filter according to $2^{nd}$ invention, wherein:

a dielectric sheet and an electrode layer are layered and co-fired into one layered structure; and said resonator and said transmission line are realized as an entire or a part of said electrode layer.

The $4^{th}$ invention of the present invention is the dielectric filter according to $3^{rd}$ invention, wherein said dielectric sheet comprises at least one dielectric layer;

said electrode layer comprises:

a plurality of resonator electrodes provided on one primary surface of said dielectric layer; and a transmission line electrode, provided on another primary surface of said dielectric layer, whose ends are input/output terminals;

said resonator electrode operates as said resonator; and in a projection drawing where said resonator electrode and said transmission line electrode are viewing from a direction perpendicular to a surface of said dielectric layer, there are a plurality of overlapping portions of said transmission line electrode and adjacent said resonator electrodes, such portion of said transmission electrode that is positioned between each central point of said overlapping portions, corresponds to said transmission line, and a part of said transmission line electrode is positioned a long central points of an overlapping portion of said resonator electrodes and said transmission line electrode, and corresponds to said transmission line.

The $5^{th}$ invention of the present invention is the dielectric filter according to $3^{rd}$ invention, wherein said dielectric sheet comprises at least five dielectric layers from a,first dielectric layer to a fifth dielectric layer;

said electrode layer comprises, at least:

a first shield electrode provided between said first dielectric layer and said second dielectric layer;

a plurality of resonator electrodes provided between said second dielectric layer and said third dielectric layer;

a transmission line electrode which has input/output terminals at both ends and is provided between said third dielectric layer and said fourth dielectric layer; and a second shield electrode provided between said fourth dielectric layer and said fifth dielectric layer;

said resonator electrode operates as a resonator; and in a projection drawing where said resonator electrode and said transmission line electrode are viewing from a direction perpendicular to a surface of said dielectric layer, there are a plurality of overlapping portions of said transmission line electrode and adjacent said resonator electrodes, such portion of said transmission electrode that is positioned between each central point of said overlapping portions, corresponds to said transmission line, and a part of said transmission line electrode is positioned along central points of an overlapping portion of said resonator electrodes and said transmission line electrode, and corresponds to said transmission line.

The $6^{th}$ invention of the present invention is the dielectric filter according to $5^{th}$ invention, further comprising:

a plurality of adjusting electrodes provided on a surface of said fifth dielectric layer on which said second shield electrode is not provided; and side electrodes which are provided on sides of said layered structure of said first to fifth dielectric layers and are connected to the input/output terminals on both ends of said transmission line electrode, wherein said plurality of adjusting electrodes and said side electrodes are interconnected.

The $7^{th}$ invention of the present invention is the dielectric filter according to $3^{rd}$ invention, wherein said dielectric sheet comprises at least five dielectric layers from a first dielectric layer to a fifth dielectric layer;

said electrode layer comprises at least:

a first shield electrode provided between said first dielectric layer and said second dielectric layer;

a plurality of first resonator electrodes provided between said second dielectric layer and said third dielectric layer;

a transmission line electrode which has input/output terminals at both ends and is provided between said third dielectric layer and said fourth dielectric layer;

a second shield electrode provided between said fourth dielectric layer and said fifth dielectric layer;

a second resonator electrode provided on a surface of said fifth dielectric layer on which said second shield electrode is not provided; and a third resonator electrode which are provided on outer peripheral sides of said layered structure of said first to fifth dielectric layers and are connected to one end of said first resonator electrode and one end of said second resonator electrode;

said resonator electrode operates as a resonator; and in a projection drawing where said resonator electrode and said transmission line electrode are viewing from a direction perpendicular to a surface of said dielectric layer, there are a plurality of overlapping portions of said transmission line electrode and adjacent said resonator electrodes, such portion of said transmission electrode that is positioned between each central point of said overlapping portions, corresponds to said transmission line, and a part of said transmission line electrode is positioned a long central points of an overlapping portion of said resonator electrodes and said transmission line electrode, and corresponds to said transmission line.

The $8^{th}$ invention of the present invention is the dielectric filter according to $3^{rd}$ invention, wherein said dielectric sheet comprises at least seven dielectric layers from a first dielectric layer to a seventh dielectric layer;

said electrode layer comprises at least:

a first shield electrode provided between said first dielectric layer and said second dielectric layer;

a plurality of first resonator electrodes provided between said second dielectric layer and said third dielectric layer;

a third shield electrode provided between said third dielectric layer and said fourth dielectric layer;

a second resonator electrode provided between said fourth dielectric layer and said fifth dielectric layer;

a transmission line electrode which has input/output terminals on both ends and provided between said fifth dielectric layer and said sixth dielectric layer;

a second shield electrode provided between said sixth dielectric layer and said seventh dielectric layer; and a third resonator electrode which are provided on outer peripheral sides of said layered structure of said first to seventh dielectric layers and are connected to one end of said first resonator electrode and one end of said second resonator electrode;

said resonator electrode operates as a resonator; and in a projection drawing where said resonator electrode and said transmission line electrode are viewing from a direction perpendicular to a surface of said dielectric layer, there are a plurality of overlapping portions of said transmission line electrode and adjacent said resonator electrodes, such portion of said transmission electrode that is positioned between each central point of said overlapping portions, corresponds to said transmission line, and a part of said transmission line electrode is positioned a long central points of an overlapping portion of said resonator electrodes and said transmission line electrode, and corresponds to said transmission line.

The $9^{th}$ invention of the present invention is the dielectric filter according to any one of $1^{st}$ to $3^{rd}$ inventions, wherein an open end of said resonator is a wide portion and a short circuit side is a narrow portion with a line width on the short circuit side made narrower halfway of said resonator.

The $10^{th}$ invention of the present invention is the dielectric filter according to any one of $1^{st}$ to $3^{rd}$ inventions, wherein a central portion of said resonator is a wide portion, and a short circuit side and an open end side are narrow portions.

The $11^{th}$ invention of the present invention is the dielectric filter according to any one of $1^{st}$ to $3^{rd}$, $9^{th}$, and $10^{th}$ inventions, wherein one end of said plurality of resonators is short circuited, and another end is set open.

The $12^{th}$ invention of the present invention is the dielectric filter according to any one of $1^{st}$ to $3^{rd}$, $9^{th}$, and $10^{th}$ inventions, wherein both ends of said plurality of resonators are open or short circuited.

The $13^{th}$ invention of the present invention is the dielectric filter according to any one of $5^{th}$, $7^{th}$, and $8^{th}$ inventions, wherein all or a part of said first to third shield electrodes are connected and grounded.

The $14^{th}$ invention of the present invention is the dielectric filter according to any one of $5^{th}$, $7^{th}$, and $8^{th}$ incentions, wherein said first to fifth dielectric layers or said first to seventh dielectric layers have different thicknesses.

The $15^{th}$ invention of the present invention is the dielectric filter according to any one of $5^{th}$, $7^{th}$, and $8^{th}$ inventions, wherein said first to fifth dielectric layers or. said first to seventh dielectric layers comprise-dielectrics having relative dielectric constant.

The $16^{th}$ invention of the present invention is a antenna duplexer, wherein a dielectric filter according to any one of $1^{st}$ to $15^{th}$ inventions is used as one or both of a transmission filter and a reception filter.

The $17^{th}$ invention of the present invention is a communications appliance using a dielectric filter according to any one of $1^{st}$ to $15^{th}$ inventions.

The $18^{th}$ invention of the present invention is the dielectric filter according to any one of $1^{st}$ to $8^{th}$ inventions used in microwave bands.

The $19^{th}$ invention of the present invention is the dielectric filter according to any one of 1 to 8, wherein a line length of said transmission line is at least equal to or longer than 1/102 of a wavelength corresponding to a resonance frequency of said resonator.

Normally, in the filter theory, the line length of a transmission line connecting resonators is ¼ of the wavelength corresponding to the resonance frequency of a resonator to realize the band rejection characteristic at the resonance frequency of the resonator. However, according to the present invention, the line length of a transmission line connecting resonators can be shorter than ¼ of the wave length corresponding to the resonance frequency of a resonator to realize the band rejection characteristic at the resonance frequency of the resonator.

Since another dielectric filter according to the present invention can be free of becoming zigzag or wasteful wiring line using the above mentioned configuration, the present invention can provides a dielectric filter having a low loss characteristic at a pass band frequency.

In addition, with the above mentioned configuration, it is desired that a plurality of resonator electrodes and transmission line electrodes, are provided in a dielectric.

Furthermore, with the above mentioned configuration, since filter components can be arranged between upper and lower shield electrodes, a dielectric filter having a desired filter characteristic can be designed with no influence of an external electromagnetic field.

Furthermore, with the above mentioned configuration, a smaller dielectric filter can be realized using a dielectric sheet having a high specific inductive capacity. Additionally, a smaller communications appliance can also be realized.

With the above mentioned configuration, it is desired that a dielectric layer is layered below the first shield electrode and above the second shield electrode. With the configuration, the first and second shield electrodes can be protected.

Since another dielectric filter according to the present invention can form a resonator electrode by an external electrode with the above mentioned configuration, the filter characteristic can be adjusted in a trimming process using a luter, etc. Therefore, since the thickness and the specific inductive capacity of a dielectric sheet, and the inconstant electrode pattern can be absorbed, the yield in mass production can be improved.

In addition, since another dielectric filter according to the present invention can form an adjusting electrode using an external electrode with the above mentioned configuration, the adjustable frequency range can be extended by performing a trimming process using a luter, etc., thereby easily realizing an impedance matching dielectric filter. Furthermore, since the thickness and the specific inductive capacity of a dielectric sheet, and the inconstant electrode pattern can be absorbed, the yield in mass production can be improved.

Furthermore, since another dielectric filter according to the present invention can have a resonator electrode positioned not opposites a transmission line electrode with the above mentioned configuration, unnecessary electromagnetic field coupling between a resonator electrode and a transmission line electrode can be reduced, thereby successfully providing an easily designed dielectric filter.

Additionally, another dielectric filter according to the present invention has an open end of a resonator electrode as a wide portion, and a short circuit end as a narrow portion.

With the structure, a resonance frequency can be lowered without a long resonator electrode, thereby providing a smaller dielectric filter.

Furthermore, another dielectric filter according to the present invention has the central portion of a resonator electrode as a wide portion, and a short circuit end and an open end as narrow portions. With the configuration, the deterioration by a conductor loss can be suppressed more effectively than a constant width of a resonator electrode, thereby successfully providing a dielectric filter having a low loss characteristic.

The $20^{th}$ invention of the present invention is a dielectric filter comprising at least one transmission line, a plurality of resonators connected to said transmission line, and a plurality of capacitors provided between said resonator and said transmission line, and forming a band rejection characteristic around the resonance frequency of the resonator, wherein a plurality of values of capacitances of said capacitors are different to each other.

The $21^{st}$ invention of the present invention is the dielectric filter according to $20^{th}$ inventions, wherein:

said transmission line has input/out put terminals at both ends; and said each capacitor of plurality of capacitors has different capacity values depending on impedance conditions at each input/output terminal of said transmission line.

The $22^{nd}$ invention of the present invention is the dielectric filter according to $21^{st}$ invention, wherein among said plurality of input/output terminals, capacity values of input/output terminals having higher impedance are smaller than capacity values of input/output terminals having lower impedance.

The $23^{rd}$ invention of the present invention is the dielectric filter according to $20^{th}$ invention; wherein said transmission line is formed by said resonator and said transmission line, which are plane electrodes, on a plurality of dielectric sheets as a layered structure co-fired into laminated structure.

The $24^{th}$ invention of the present invention is a dielectric filter having a layered structure, comprising:

a first shield electrode;

a dielectric layer, (1) provided on said first shield electrode;

a plurality of resonator electrodes provided on said dielectric layer (1);

a dielectric layer (2) provided on said plurality of resonator electrodes;

a transmission line electrode which are provided on said dielectric layer (2) and whose both ends are input/output terminals;

a plurality of capacitors connected to said transmission line electrode, provided on same dielectric layer (2), positioned opposite said plurality of resonator electrodes partially through said dielectric layer (2);

a dielectric layer (3) provided on said transmission line electrode and said plurality of capacitor electrodes;

a second shield electrode provided on said dielectric layer (3); and side electrodes provided on sides, wherein a band rejection characteristic is formed around a resonance frequency of said resonator; and an area of said resonator electrode opposite said capacitor electrode through said dielectric layer (2) is different each other from an area of said capacitor electrode.

The $25^{th}$ invention of the present invention is the dielectric filter according to $24^{th}$ invention, wherein open ends of said plurality of resonator electrodes are connected to other respective side electrodes.

The $26^{th}$ invention of the present invention is the dielectric filter according to $25^{th}$ invention, wherein a dielectric layer (4) is provided on said second shield electrode, adjusting electrodes equal in number to said resonator electrodes are provided on a top surface of said dielectric layer (4), and, among said plurality of side electrodes, said adjusting electrodes are connected to side electrodes connected to said resonator electrode respectively.

The $27^{th}$ invention of the present invention is the dielectric filter according to $24^{th}$ invention, wherein said side electrodes are connected to both input/output terminals of said transmission line electrode, a dielectric layer (4) is provided on said second shield electrode, an adjusting electrode is provided on a top surface of said dielectric layer (4), and said side electrodes connected to said transmission line electrode are connected to said adjusting electrodes respectively.

The $28^{th}$ invention of the present invention is the dielectric filter according to $24^{th}$ invention, wherein one end of each of said plurality of resonator electrodes is connected to a predetermined side electrode through a short circuit end, and another end of each of said plurality of resonator electrodes is an open end.

The $29^{th}$ invention of the present invention is the dielectric filter according to $24^{th}$ invention, wherein both ends of said plurality of resonator electrodes are open ends.

The $30^{th}$ invention of the present invention is the dielectric filter according to $24^{th}$ invention, wherein among said plurality of resonator electrodes, a thickness of at least one resonator electrode is different from thicknesses of other resonator electrodes.

The $31^{st}$ invention of the present invention is the dielectric filter according to $24^{th}$ invention, wherein each of said dielectric layers has a dielectric material having a different specific inductive capacity.

The $32^{nd}$ invention of the present invention is a antenna duplexer, comprising: a transmission filter and a reception filter, wherein said transmission filter and/or said reception filter comprises the dielectric filter according to any one of $20^{th}$ to $31^{st}$ inventions.

The $33^{rd}$ invention of the present invention is a communications appliance, comprising:

an antenna;

a matching circuit connected to said antenna:

a transmission filter connected to said matching circuit;

a transmission circuit connected to said transmission filter;

a reception filter connected to said matching circuit; and a reception circuit connected to said reception filter, wherein said transmission filter and/or said reception filter comprise the dielectric filter according to any one of $20^{th}$ to $31^{st}$ inventions.

The $34^{th}$ invention of the present invention is a dielectric filter, comprising:

a plurality of resonators;

at least one transmission line provided among said plurality of resonators; and a capacitor provided between said resonator and said transmission line, wherein:

a band rejection characteristic is formed around a resonance frequency of said resonator;

a line length of said transmission line is shorter th an ¼ of a length of a waveform corresponding to a resonance frequency of said resonator; and said plurality of capacitors have different capacity values.

The $35^{th}$ invention of the present invention is the dielectric filter according to $34^{th}$ inventions, wherein:

said plurality of resonators are coupled in electromagnetic field;

said transmission line has input/output terminals at both ends; and each capacitor of said plurality of capacitors has different capacity values depending on impedance conditions at each input/output terminal of said transmission line.

The $36^{th}$ invention of the present invention is the dielectric filter according to $35^{th}$ invention, wherein among said plurality of input/output terminals, capacity values of input/output terminals having higher impedance are smaller th an capacity values of input/output terminals having lower impedance.

The $37^{th}$ invention of the present invention is the dielectric filter according to any one of $34^{th}$ to $36^{th}$ inventions, wherein:

a dielectric sheet and an electrode layer are layered and co-fired into one layered structure; and said resonator and said transmission line are realized as an entire or a part of said electrode layer.

The $38^{th}$ invention of the present invention is a dielectric filter, comprising:

a plurality of resonators; and at least one transmission line provided among said plurality of resonators, wherein a band rejection characteristic is formed around a resonance frequency of said resonator, and a line length of said transmission line is longer th an ¼ of a wavelength corresponding to the resonance frequency of said resonator.

The $39^{th}$ invention of the present invention is the dielectric filter according to $38^{th}$ invention, wherein said plurality of resonators are coupled in electromagnetic field.

The $40^{th}$ invention of the present invention is the dielectric filter according to $39^{th}$ invention, wherein:

a dielectric sheet and an electrode layer are layered and co-fired into one layered structure; and said resonator and said transmission line are realized as an entire or a part of said electrode layer.

BRIEF DESCRIPTION OF THE DRAWINGS

FIG. 2 (*b*) shows an equivalent circuit of a transmission line of the dielectric filter according to the conventional technology;

FIG. 3(*b*) shows an equivalent circuit of the transmission line of the dielectric filter according to the first embodiment and another embodiment of the present invention;

FIG. 3(*c*) shows a transmission line of the dielectric filter according to an embodiment of another aspect of the present invention;

FIG. 3(*d*) shows an equivalent circuit of the transmission line of the dielectric filter according to an embodiment of an other aspect of the present invention;

| Description of Symbols | |
|---|---|
| 101 | Transmission line electrode |
| 102a, 102b | Resonator |
| 103a, 103b | Capacitor |
| 201 | First dielectric layer |
| 202 | First shield electrode |
| 203 | Second dielectric layer |
| 204a, 204b | First resonator electrode |
| 205 | Third dielectric layer |
| 206 | Transmission line electrode |
| 207 | Fourth dielectric layer |
| 208 | Second shield electrode |
| 209 | Fifth dielectric layer |
| 210a, 210b, 210c, 210d, 210e, 210f | Side electrode |
| 211a, 211b | Side electrode |
| 212a, 212b | Second resonator electrode |
| 213a, 213b | Third resonator electrode |
| 214a, 214b | Adjusting electrode |
| 220 | Resonator electrode |
| 221 | Dielectric |
| 222 | Transmission line electrode |
| 223 | Overlapping portion |
| 224 | Central point |
| 301 | First dielectric layer |
| 302 | First shield electrode |
| 303 | Second dielectric layer |
| 304a, 304b | First resonator electrode |
| 305 | Third dielectric layer |
| 306 | Third shield electrode |
| 307 | Fourth dielectric layer |
| 308a, 308b | Second resonator electrode |
| 309 | Fifth dielectric layer |
| 310 | Transmission line electrode |
| 311 | Sixth dielectric layer |
| 312 | Second shield electrode |
| 313 | Seventh dielectric layer |
| 314a, 314b, 314c, 314d, 314d, 314e, 314f | Side electrode |
| 315a, 315b | Third resonator electrode |
| 401 | First dielectric layer |
| 402 | Second dielectric layer |
| 403 | Third dielectric layer |
| 404 | Fourth dielectric layer |
| 405 | Fifth dielectric layer |
| 406a, 406b | Resonator electrode |
| 407a, 407b, 407c | Transmission line electrode |
| 408a, 408b | Notch capacity electrode |
| 409 | First shield electrode |
| 410 | Second shield electrode |
| 411a, 411b, 411c, 411d, 411e, 411f | Side electrode |
| 412 | Side electrode |
| 413 | Side electrode |
| 501a, 501b | Resonator |
| 501a, 502b, 502c | Transmission line electrode |
| 503a, 503b | Capacitor |
| 1101 | Transmission line between input/output terminals |
| 1102a | Capacitor |
| 1102b | Capacitor |
| 1103a | Resonator |
| 1103b | Resonator |

PREFERRED EMBODIMENTS OF THE INVENTION

The embodiments of the present invention are described below by referring to the attached drawings.

First Embodiment

Figure 1:
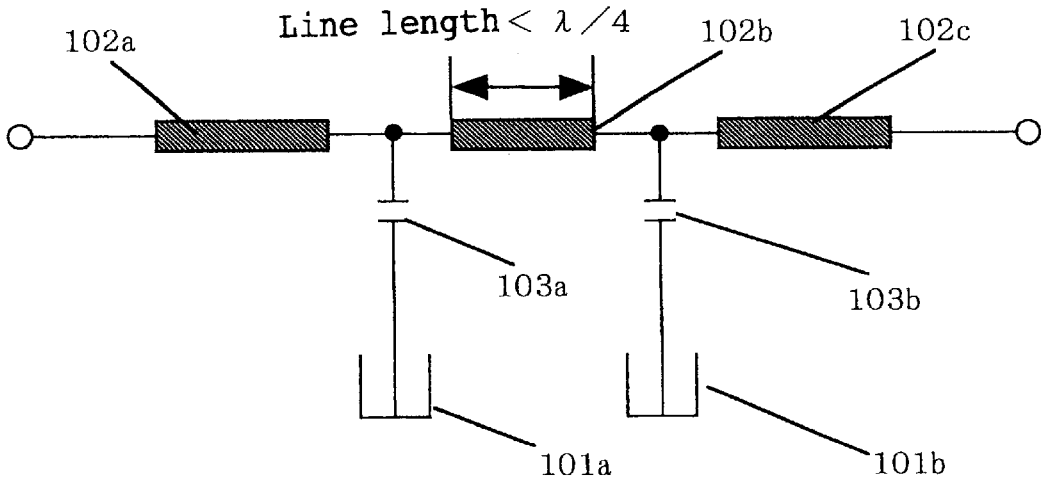
FIG. 1 shows an equivalent circuit of a dielectric filter according to a first embodiment of the present invention.

FIG. 1 shows an equivalent circuit of the filter according to a first embodiment of the present invention.

In FIG. 1, a filter forming a band rejection characteristic around the resonance frequency of a resonator is configured by a circuit in which a transmission line 102 having input/output terminals at both ends is connected to two resonators 101*a* and 101*b* respectively th rough capacitors 103*a* and 103*b*.

In FIG. 1, since the resonators 101*a* and 101*b* are connected parallel to the transmission line th rough the capacitors, the resonators 101*a* and 101*b* form an attenuation pole around the resonance frequency, and functions as a filter having a band rejection characteristic.

Figure 2:
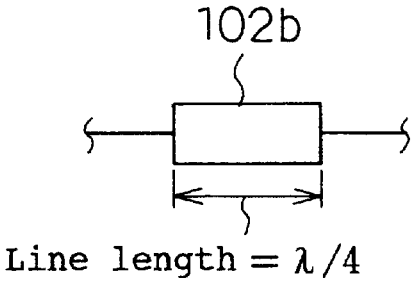
FIG. 2(*a*) shows a transmission line of the dielectric filter according to a conventional technology.
Figure 2:
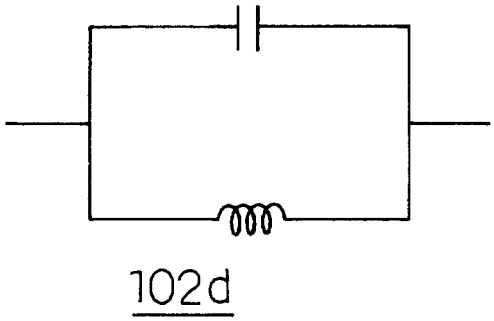
Figure 3:
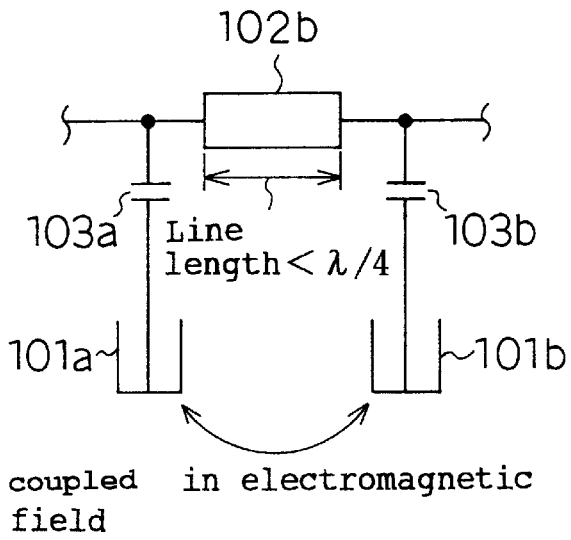
FIG. 3(*a*) shows a transmission line of the dielectric filter according to the first embodiment and an other embodiment of the present invention.
Figure 3:
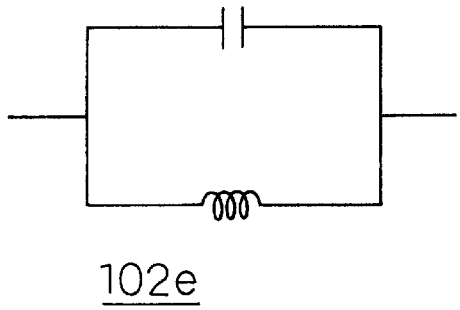
Figure 3:
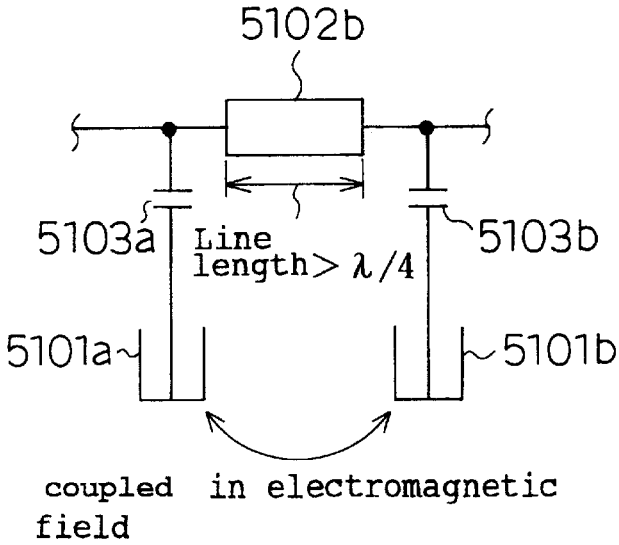
Figure 3:
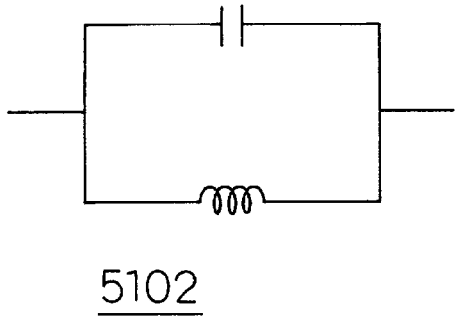

Conventionally, in the filter theory, it is necessary to have infinite impedance at the resonance frequency of a resonator to form a band rejection characteristic. To attain th is, as shown in FIG. 2(*a*) the line length of the transmission line 102*b* is set as ¼ of the wavelength corresponding to the resonance frequency of a resonator, and the transmission line 102*b* is allowed to function as a parallel resonant circuit 102*d* of the equivalent circuit shown in FIG. 3(*b*). The Inventor has found that, with the configuration, a filter forming a band rejection characteristic around the resonance frequency of a resonator can be realized by coupling in electromagnetic field the resonator 101*a* with the resonator 101*b* although the line length of the transmission line 102*b* is set shorter than ¼ of the wavelength corresponding to the resonance frequency of the resonator as shown in FIG. 3(*a*). That is, in the conventional filter theory, it is necessary to set the line length of a transmission line equal to ¼ of the wavelength corresponding to the resonance frequency of a resonator to obtain infinite impedance. However, according to the present invention, the effect of the conventional technology can be obtained by configuring a parallel resonant circuit 102*e* by a transmission line and a resonator which are coupled in electromagnetic field as shown by the equivalent circuit shown in FIG. 3(*b*) although the line length of the transmission line is set shorter th an ¼ of the wavelength corresponding to th e resonance frequency of the resonator.

The filter according to the present embodiment can have the above mentioned effect only if the resonator 101*a* is coupled with the resonator 101*b* in electromagnetic field, which is described below in the following embodiments.

In the present embodiment, the resonators are defined as two resonators 101*a* and 101*b*, However, the present invention can have the similar effect by providing three or more resonators.

According to the present embodiment, resonators, transmission lines, and capacitors can be formed in various methods, but the present invention is not limited to the details of the methods.

Second Embodiment

Figure 4:
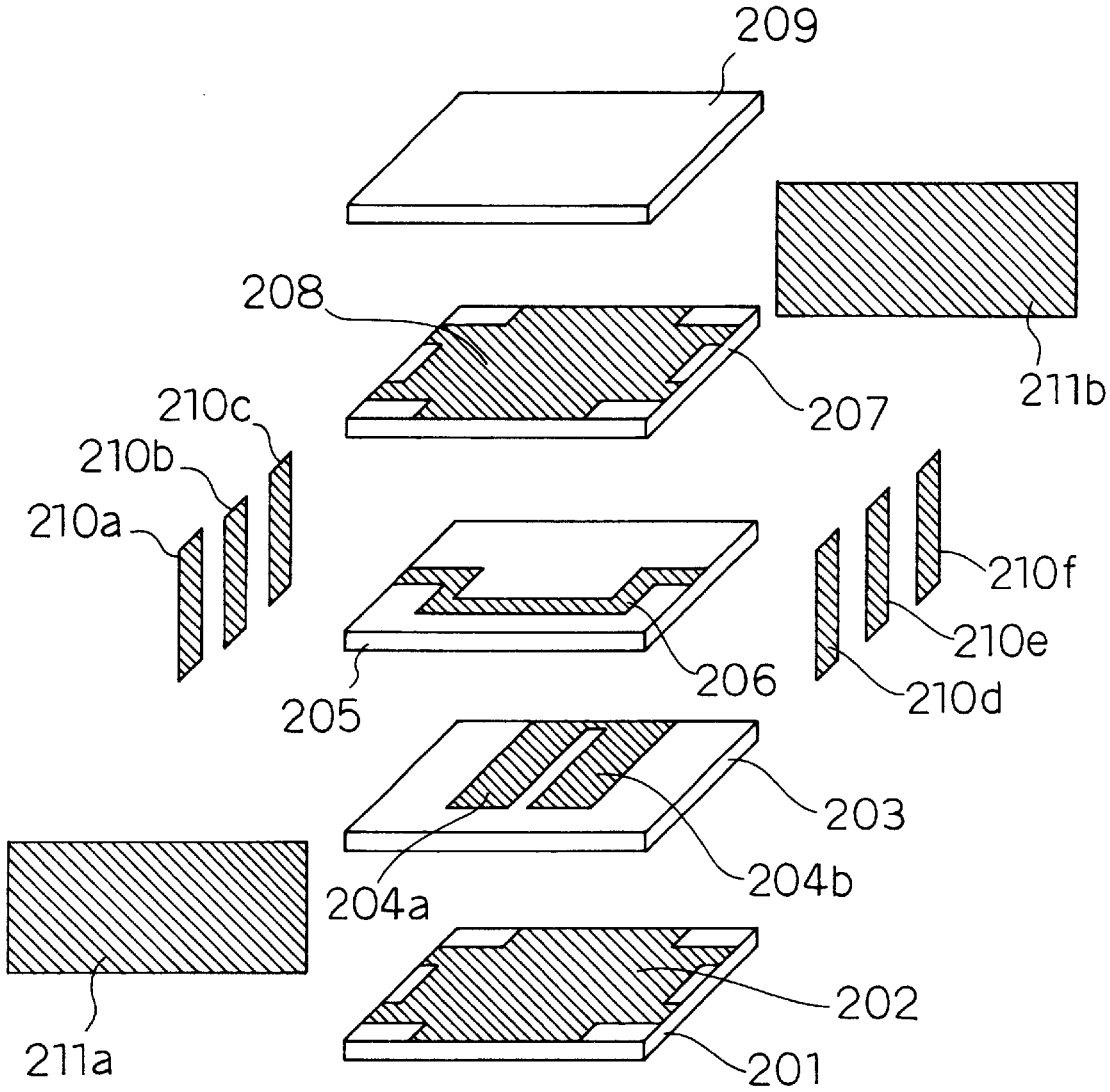
FIG. 4 is an analytic oblique view of a dielectric filter according to a second embodiment of the present invention.
Figure 5:
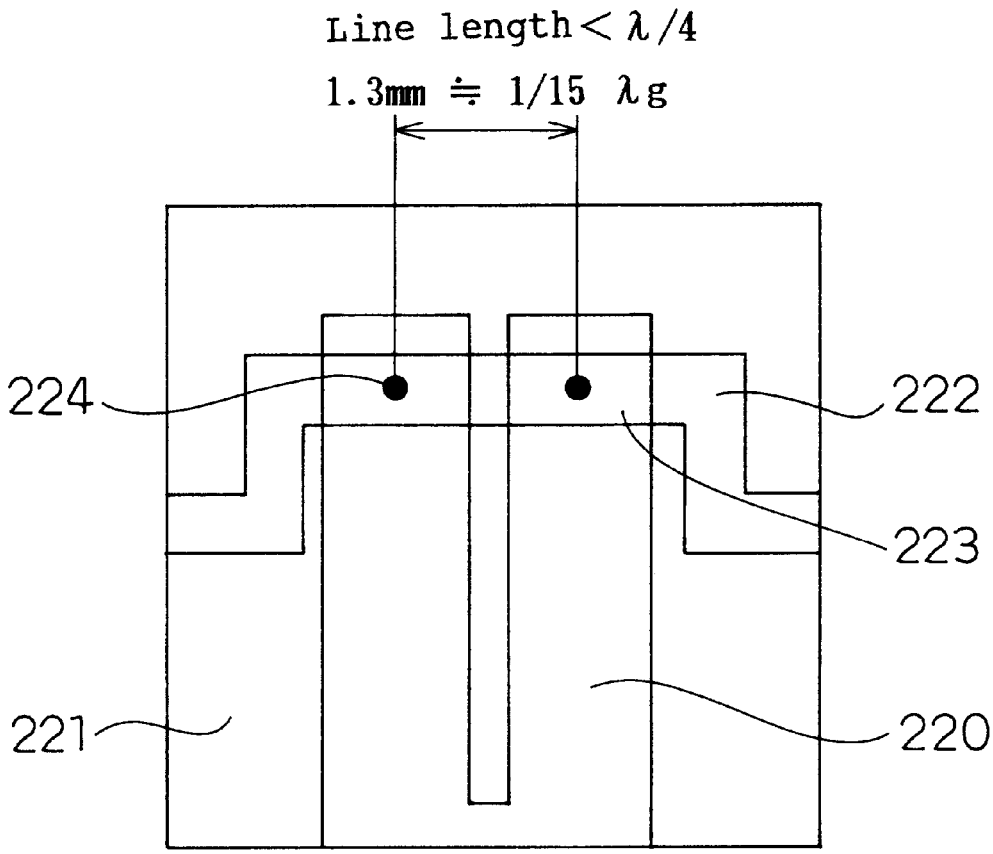
FIG. 5 is a projection view of a dielectric filter according to the second embodiment of the present invention.

FIG. 4 is a analytic oblique view of the dielectric filter having a layered structure according to a second embodiment of the present invention. FIG. 5 is a projection view of a resonator electrode and a transmission line electrode forming th e dielectric filter in a layered structure. In FIG. 4, the dielectric filter according to the present embodiment has a first shield electrode 202 on the top surface of a first dielectric layer 201, a second dielectric layer 203 above the first shield electrode 202, resonator electrodes 204*a* and 204*b* on the top surface of the second dielectric layer 203, a third dielectric layer 205 above the resonator electrodes 204*a* and 204*b*, a transmission line electrode 206 between input/output terminals on the top surface of the third dielectric layer 205, a fourth dielectric layer 207 above the transmission line electrode 206, a second shield electrode 208 on the top surface of the fourth dielectric layer 207, and a fifth dielectric layer 209 above the second shield electrode 208.

Furthermore, six (a to f) side electrodes 210 are provided on the side of the dielectric configured by layering the first. to fifth dielectric layers. One end of the transmission line electrode 206 is connected to the side electrode 210*b* the first shield electrode 202, the resonator electrodes 204*a* and 204*b*, the second shield electrode 208, and a side electrode 211*b* are connected and grounded, and the other end of the transmission line electrode 206 is connected to the side electrode 210*e*. These internal electrodes provided in the layered structure and the external electrodes provided as exposed outside the layered structure are made of metal having high conductivity such as silver, copper, gold, etc., and the electrode pattern is designed by printing or plating.

In FIG. 4, since the resonator electrodes 204*a* and 204*b* are grounded th rough the side electrodes, they form a ¼ wavelength resonator, which is set opposite the open ends of the transmission line electrode 206 and the resonator electrodes 204*a* and 204*b*, thereby form parallel plane capacitors. As a result, the parallel plane capacitors operates as two notch capacities which have a large amount of attenuation at a resonance frequency of the resonator electrodes 204*a* and 204*b*, thereby functioning as a filter forming a band rejection characteristic around the resonance frequency of the resonator electrode 204.

The relationship between the resonator electrode and the transmission line electrode in the dielectric filter according to the present embodiment is described below by referring to FIG. 5. As shown in FIG. 5, although the line length of a transmission line 222 connected between central points 224 of an overlapping portion 223 between a resonator electrode 220 and the transmission line 222, which are adjacent to each other, is set shorter th an ¼ of the wavelength corresponding the resonance frequency of the resonator formed by the resonator electrode 220, a filter having a large amount of attenuation at a desired frequency can be provided. This is described below by referring to embodiments.

Figure 6:
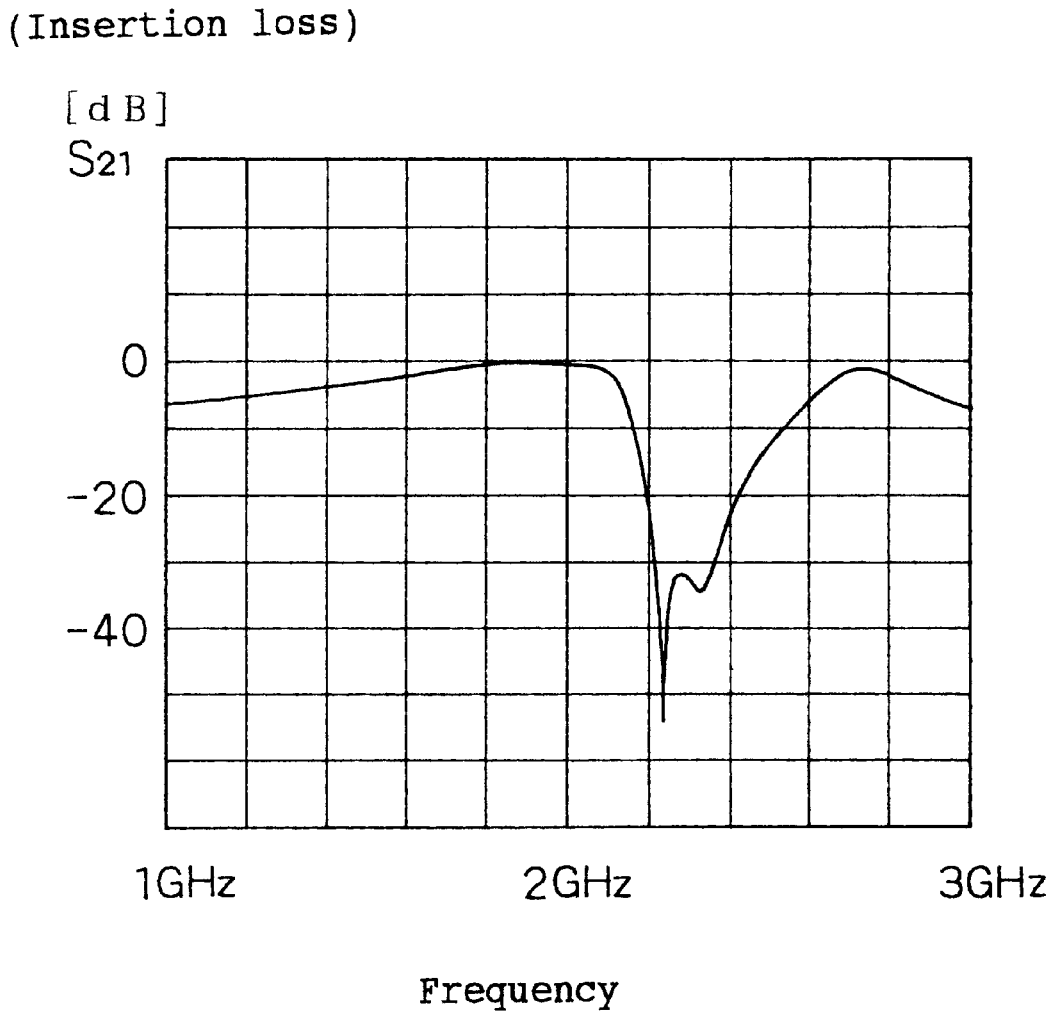
FIG. 6 shows a frequency characteristic (actual measurement value) of a dielectric filter according to the second embodiment of the present invention.

FIG. 6 is a graph of the frequency characteristic of a trial dielectric filter according to the present embodiment. The trial filter is obtained by layering dielectric sheets having a specific inductive capacity of 58 and an electrode layers mainly made of silver. The layered structure is realized by 5.0 mm depth, 4.5 mm width, and 2.0 mm height. The wavelength corresponding to the resonance frequency of th e resonator in the dielectric is 19.7 mm. The line length of the transmission line 222 connected between central points 224 of an overlapping portion 223 between a resonator electrode 220 and the transmission line 222, which are adjacent to each other, is 1.3 mm which is about 1/15 of the wavelength. The frequency area evaluating the operation of a filter is 1.5 GHz to 2.5 GHz. However, the operation area of the filter is wider than the area.

As a result of the experimentation performed on the example with the above mentioned configuration, as shown in FIG. 6, the filter forming a band rejection characteristic around the resonance frequency of the resonator according to the present embodiment has a small loss at a pass band frequency (equal to or lower than 2.0 GHz), and a large amount of attenuation at a rejection band frequency.

Figure 7:
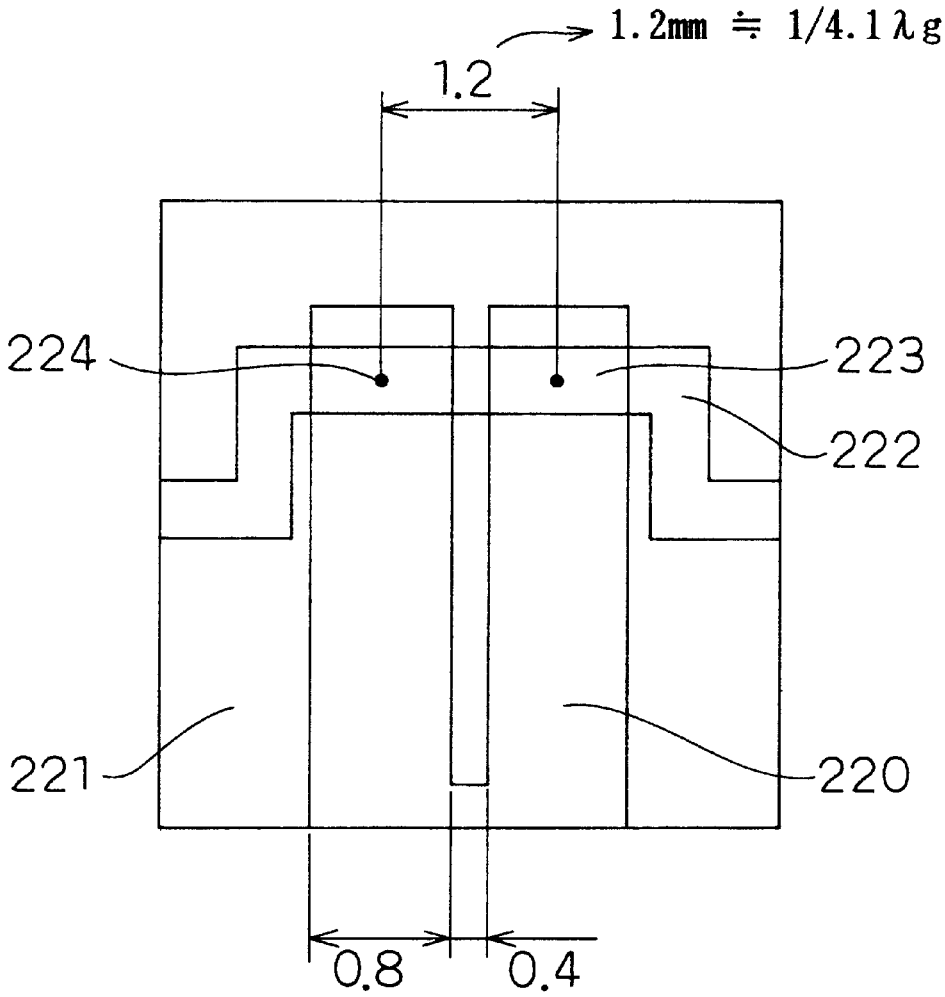
FIG. 7 is an analytic oblique view of another embodiment of a dielectric filter according to the second embodiment of th e present invention.
Figure 8:
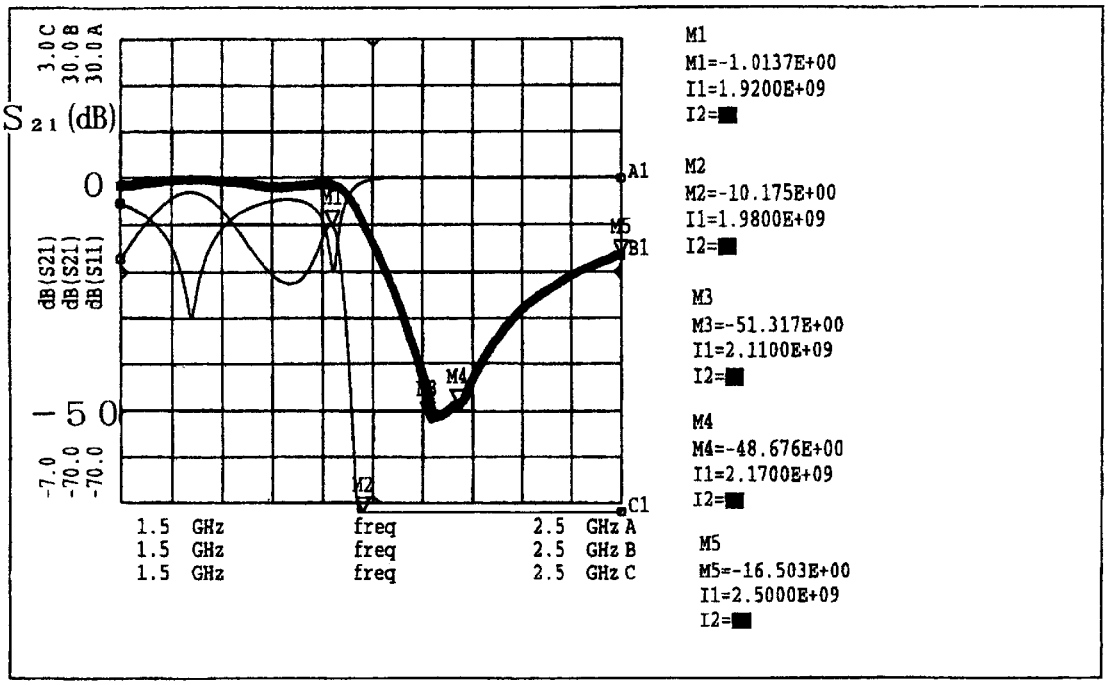
FIG. 8 shows a frequency characteristic (simulation value) according to another embodiment of a dielectric filter according to the second embodiment of the present invention.
Figure 8:
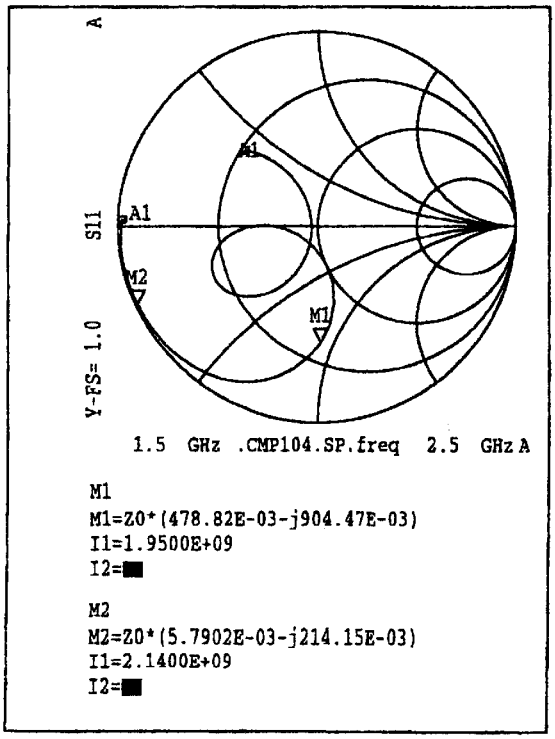
Figure 8:
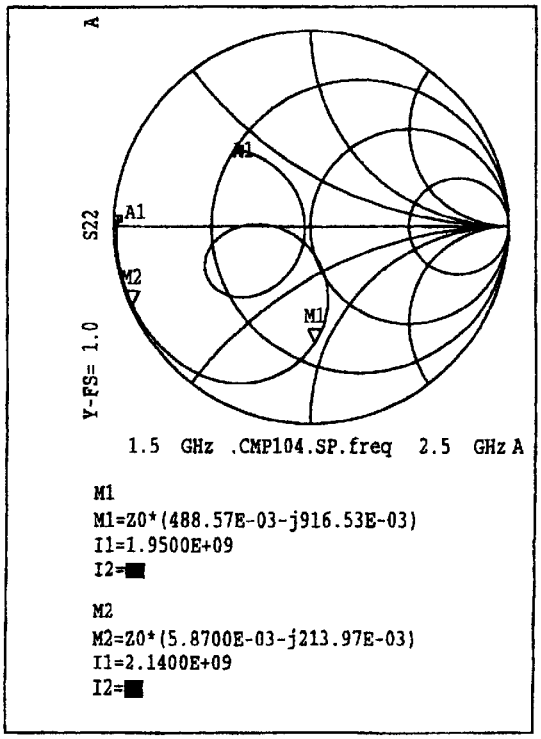

FIG. 7 is a graph of the frequency characteristic of a trial dielectric filter according to the present embodiment. As shown in FIG. 8, the trial filter is obtained by layering dielectric sheets having a specific inductive capacity of 58 and an electrode layers mainly made of silver. The layered structure is realized by 5.0 mm depth, 4.5 mm width , and 2.0 mm height. The wavelength corresponding to the resonance frequency of the resonator in the dielectric is 19.7 mm. The line length of the transmission line 222 connected between central points 224 of an overlapping portion 223 between a resonator electrode 220 and the transmission line 222, which are adjacent to each other, is 4.8 mm which is about 1/4.1 of the wavelength. The frequency area evaluating the operation of a filter is 1.5 GHz to 2.5 GHz. However, the operation area of the filter is wider than the area.

As a result of the experimentation performed on the example with the above mentioned configuration, as shown in FIG. 8, the filter forming a band rejection characteristic around the resonance frequency of the resonator according to the present embodiment has a small loss at a pass band frequency (equal to or lower than 2.0 GHz), and a large amount of attenuation at a rejection band frequency.

As described above, a satisfactory effect can be obtained at least in the range of ¼ to 1/15 of the wavelength corresponding to the resonance frequency.

Described below is an example with the simulation and measurement under other conditions.

Figure 9:
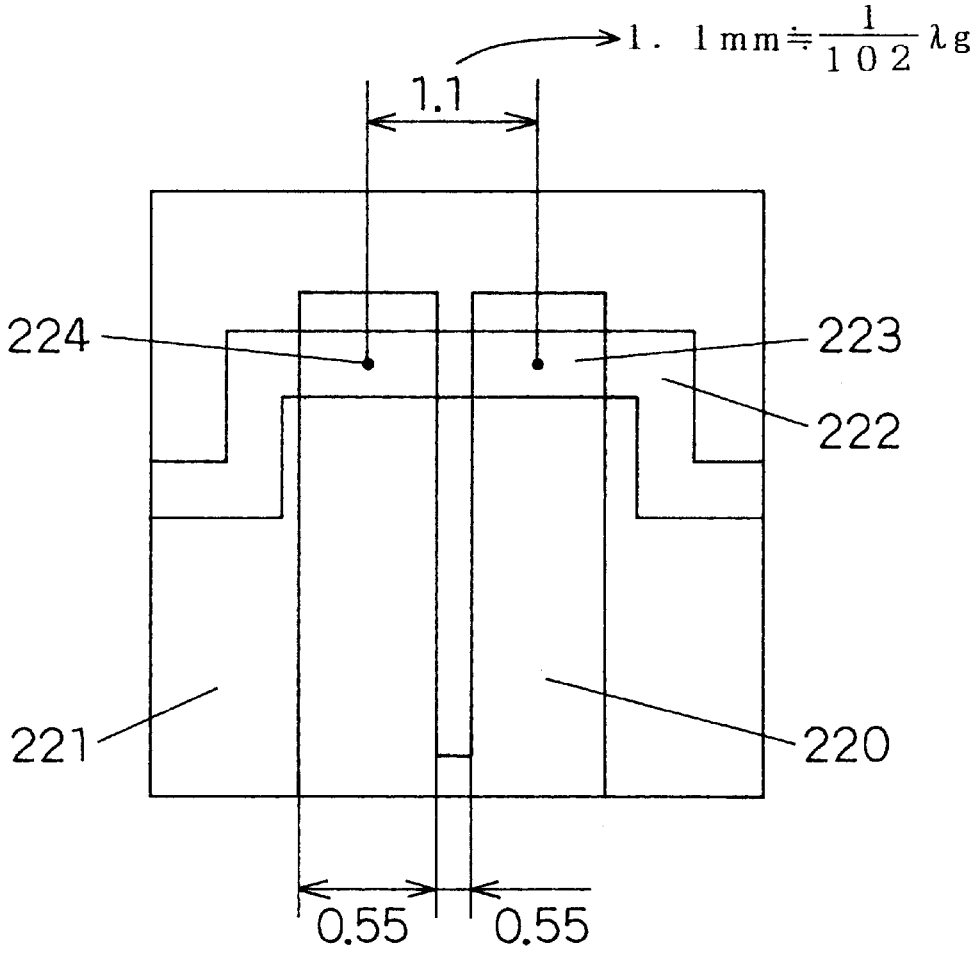
FIG. 9 is a projection view according to another embodiment of a dielectric filter according to the second embodiment of th e present invention.

According to another example of the configuration shown in FIG. 9, a dielectric sheet having the specific inductive capacity of 1.8 is used, and the fundamental frequency is 2 GHz. As a result, the wavelength corresponding to the resonance frequency of the resonator in the dielectric is 112 mm. The line length of the transmission line 222 connected between central points 224 of an overlapping portion 223 between a resonator electrode 220 and the transmission line 222, which are adjacent to each other, is 1.1 mm which is about 1/102 of the wavelength. The frequency area evaluating the operation of a filter is 1.5 GHz to 2.5 GHz. However, the operation area of the filter is wider than the area.

Figure 10:
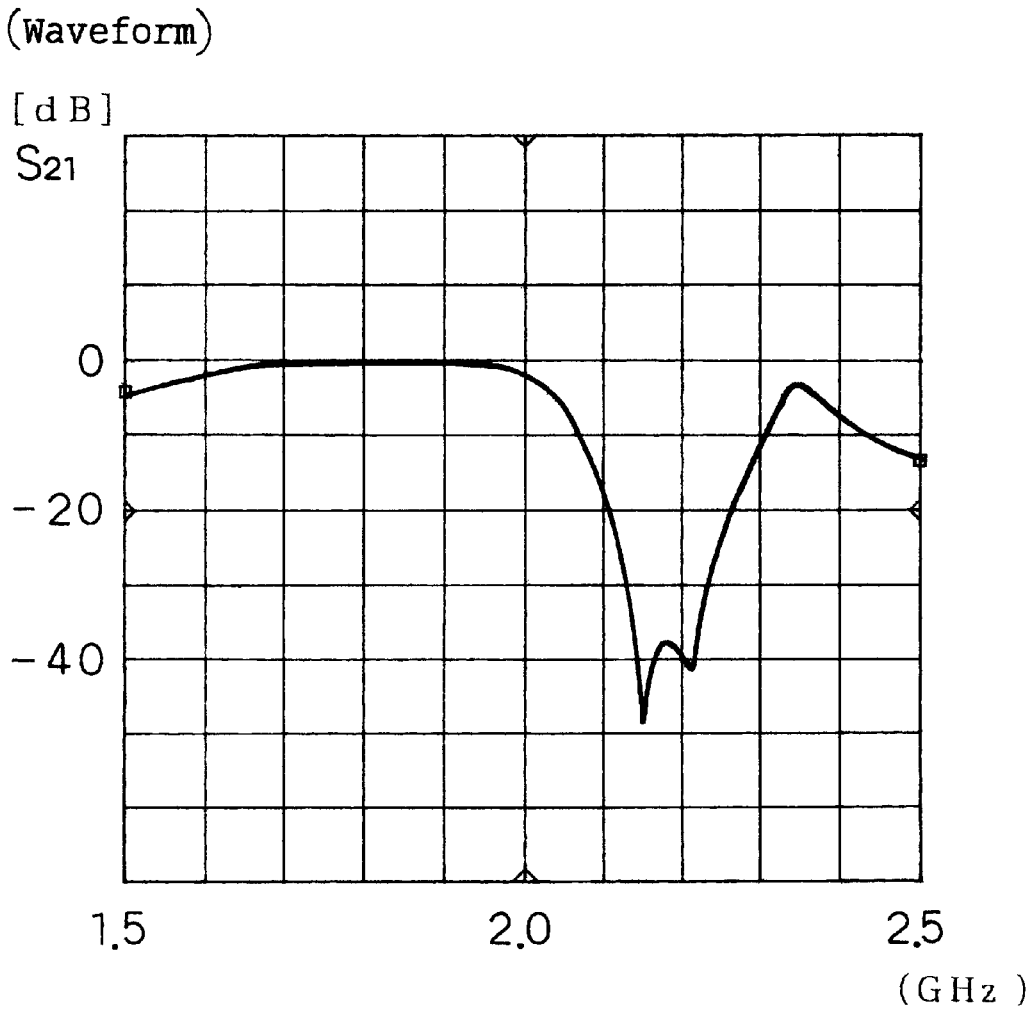
FIG. 10 shows a frequency characteristic (simulation value) of a dielectric filter according to the second embodiment of the present invention.

As a result of the simulation performed with the above mentioned configuration, as shown in FIG. 10, the filter forming a band rejection characteristic around the resonance frequency of the resonator according to the present embodiment has a small loss at a pass band frequency (equal to or lower than 2.0 GHz) and a large amount of attenuation at a rejection band frequency. A satisfactory effect can be obtained at least in the range of 1/102 of the wavelength corresponding to the resonance frequency.

Figure 11:
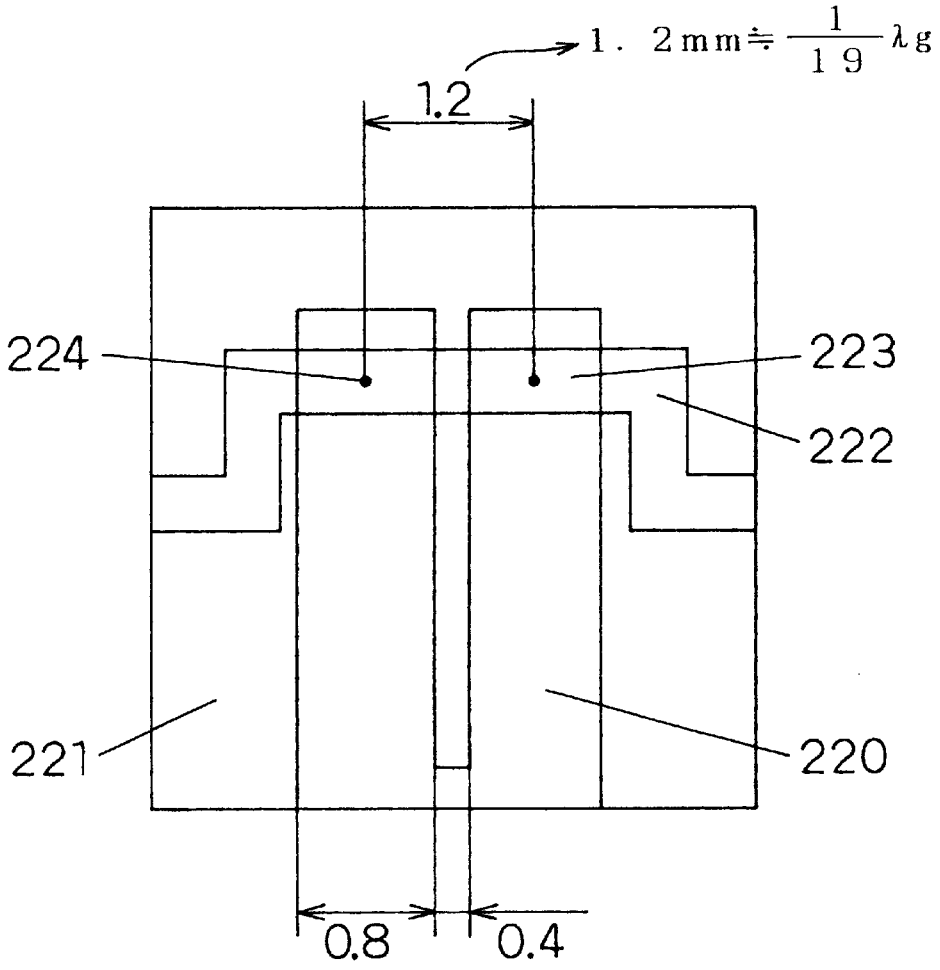
FIG. 11 shows a projection view of another embodiment of a dielectric filter according to the second embodiment of the present invention.

According to another example of the configuration as shown in FIG. 11, a dielectric sheet having the specific inductive capacity of 44 is used, and the fundamental frequency is 2 GHz. As a result, the wavelength corresponding to the resonance frequency of the resonator in the dielectric is 22.6 mm. The line length of the transmission line 222 connected between central points 224 of an overlapping portion 223 between a resonator electrode 220 and the transmission line 222, which are adjacent to each other, is 1.2 mm which is about 1/19 of the wavelength. The frequency area evaluating the operation of a filter is 1.5 GHz to 2.5 GHz. However, the operation area of the filter is wider than the area.

Figure 12:
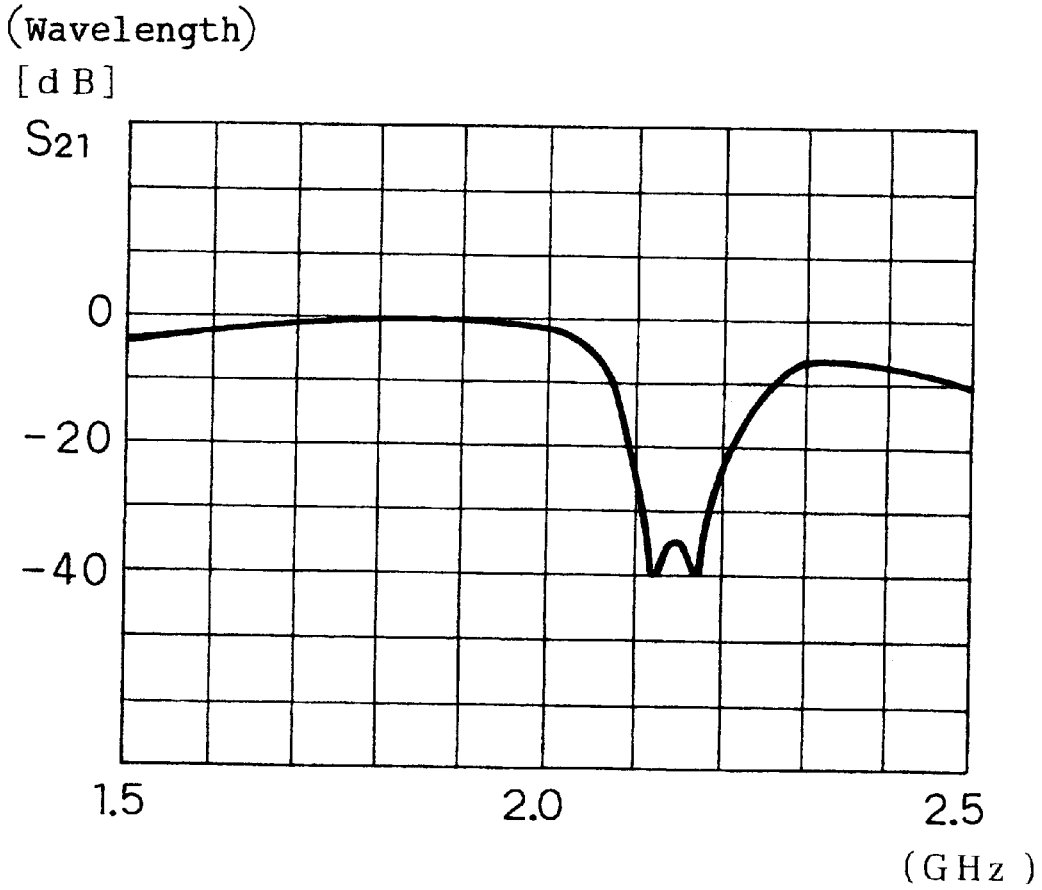
FIG. 12 shows a characteristic (actual measurement value) according to another embodiment of a dielectric filter according to the second embodiment of the present invention.

As a result of the measurement of the above mentioned configuration, as shown in FIG. 12, the filter forming a band rejection characteristic around the resonance frequency of the resonator according to the present embodiment has a small loss at a pass band frequency (equal to or lower than 2.0 GHz), and a large amount of attenuation at a rejection band frequency. A satisfactory effect can be obtained at least in the range of 1/19 of the wavelength corresponding to the resonance frequency.

As described above, according to the present embodiment, in an area shorter than 1/15, th at is, in an area having a wavelength of at least 1/102, the effect with the wavelength of ¼ can be expected. The resonance frequency is not limited to the above mentioned value, but a similar effect can be expected with a microwave area.

The above mentioned dielectric filter according to the present embodiment has a ¼ wavelength resonator whose resonator electrode has a short circuited end and an open end. However, a similar effect can be obtained with a dielectric filter using a ½ wavelength resonator having both ends set open or short circuited.

Furthermore, the above mentioned present embodiment has two resonator electrodes 220, but a similar effect can be obtained with three or more resonator electrodes.

Additionally, although there are various methods of forming the transmission line electrodes, capacitors, and resonators using parallel planes, strip lines, etc. according to the present embodiment, the present invention is not limited to these detail applications.

Furthermore, the present invention is not limited to the details of the available materials for the dielectric such as Bi type dielectric ceramics, etc.

Third Embodiment

Figure 13:
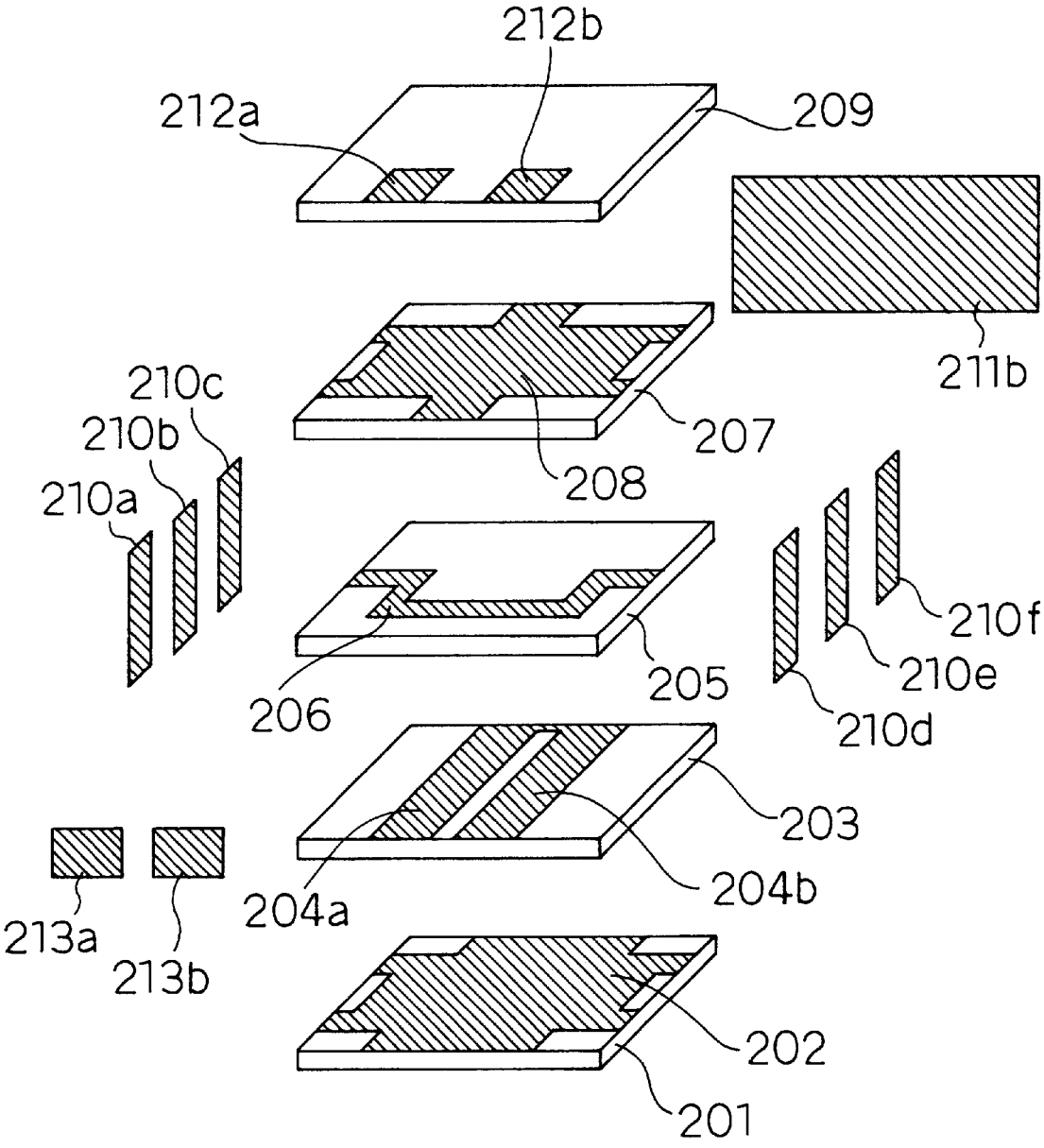
FIG. 13 is an analytic oblique view of a dielectric filter according to a third embodiment of the present invention.

FIG. 13 is an analytic oblique view of the structure of the dielectric filter according to a third embodiment of the present invention. Since the present embodiment is basically the same as the second embodiment in structure, corresponding units are assigned the same numbers, and the detailed explanation is omitted here. According to the present embodiment, second resonator electrodes 212*a* and 212*b* are provided on the top surface of the fifth dielectric layer 209, a third resonator electrode 213*a* is connected to the second resonator electrode 212*a*, and a third resonator electrode 213*b* is connected to the second resonator electrode 212*b*. With the configuration, the resonance frequency can be adjusted by trimming the second resonator electrodes 212*a* and 212*b* using a luter, etc.

With the above mentioned configuration, in addition to the effect as a dielectric filter similar to that according to the second embodiment, an adjustable frequency range can be extended by providing the second resonator electrodes 212*a* and 212*b* opposite the second shield electrode 208 through the fifth dielectric layer 209, and forming a parallel plane capacitor functioning as a load capacity. Therefore, since the structure can be easily adjusted, and then the frequency characteristic can be adjusted by trimming the adjusting electrode, the differences in thickness of a dielectric sheet, specific inductive capacity, and electrode pattern can be absorbed. As a result, the yield can be improved.

According to the above mentioned embodiment, the dielectric filter using a ¼ wavelength resonator having a resonator electrode whose one end is short circuited, and another end is open. However, a similar effect can be obtained with a dielectric filter using a resonator both ends of which are open or short circuited.

Furthermore, the above mentioned present embodiment has two resonator electrodes, but a similar effect can be obtained with three or more resonator electrodes.

Additionally, although there are various methods of forming the transmission line electrodes, capacitors, and resonators using parallel planes, strip lines, etc. according to the present embodiment, the present invention is not limited to these detail applications.

Furthermore, the present invention is not limited to the details of the available materials for the dielectric such as Bi type dielectric ceramics, etc.

Fourth Embodiment

Figure 14:
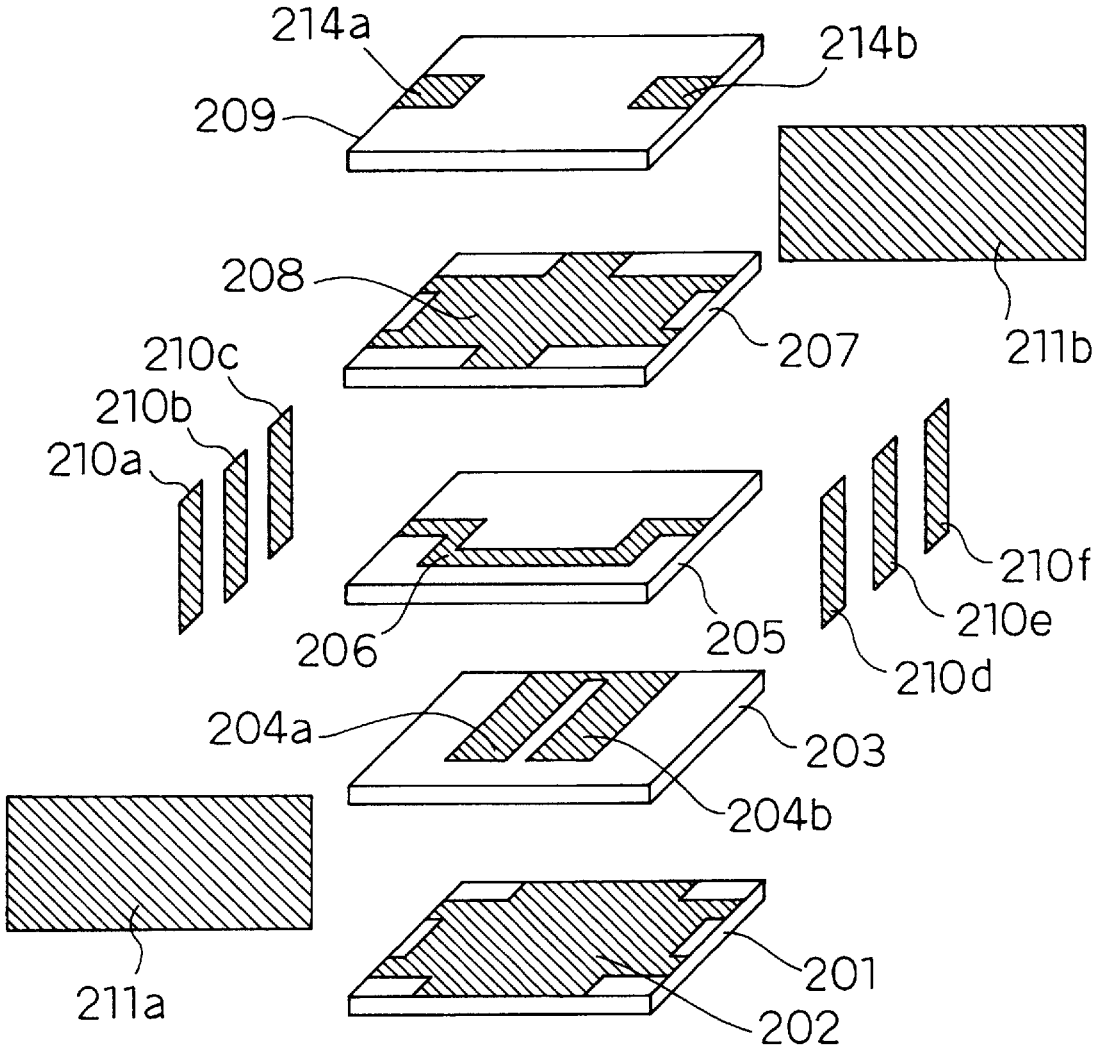
FIG. 14 is an analytic oblique view of a dielectric filter according to a fourth embodiment of the present invention.

FIG. 14 is an analytic oblique view of the structure of the dielectric filter according to a fourth embodiment of the present invention. Since the present embodiment is basically the same as the second embodiment in structure, corresponding units are assigned the same numbers, and the detailed explanation is omitted here. According to the present embodiment, adjusting electrodes 214*a* and 214*b* are provided on the top surface of the fifth dielectric layer 209, the side electrode 210*b* is connected to the adjusting electrode 214*a*, and the side electrode 210*e* is connected to the adjusting electrode 214*b*.

With the above mentioned configuration, in addition to the effect of the dielectric filter according to the second embodiment, the adjusting electrodes 214*a* and 214*b* are set opposite the second shield electrode 208 and form a parallel plane capacitor having a load capacity, and the adjusting electrode 214*a* is connected to the side electrode 210*b* while the adjusting electrode 214*b* is connected to the side electrode 210*e*, thereby functioning as matching capacities at input and output terminals respectively. Therefore, an easily adjusted structure can be realized, an adjustable frequency range can be extended by trimming the adjusting electrodes 214*a* and 214*b* using a luter, etc., and a dielectric filter whose impedance matching is easily performed can be realized.

Furthermore, the above mentioned adjusting electrode 214 can be provided either on top or reverse side of any dielectric layer such as on the reverse side of the first dielectric layer 201, the top surface of the first dielectric layer 201, etc. A plurality of adjusting electrodes 214 can also be provided. If a plurality of adjusting capacity electrodes are provided, the adjustable frequency range can be extended.

According to the above mentioned embodiment, the dielectric filter using a ¼ wavelength resonator having a resonator electrode whose one end is short circuited, and another end is open. However, a similar effect can be obtained with a dielectric filter using a ½ wavelength resonator both ends of which are open or short circuited.

Furthermore, the above mentioned present embodiment has two resonator electrodes, but a similar effect can be obtained with three or more resonator electrodes.

Additionally, although there are various methods of forming the transmission line electrodes, capacitors, and resonators using parallel planes, strip lines, etc. according to the present embodiment, the present invention is not limited to these detail applications.

Furthermore, the present invention is not limited to the details of the available materials for the dielectric such as Bi type dielectric ceramics, etc.

Fifth Embodiment

Figure 15:
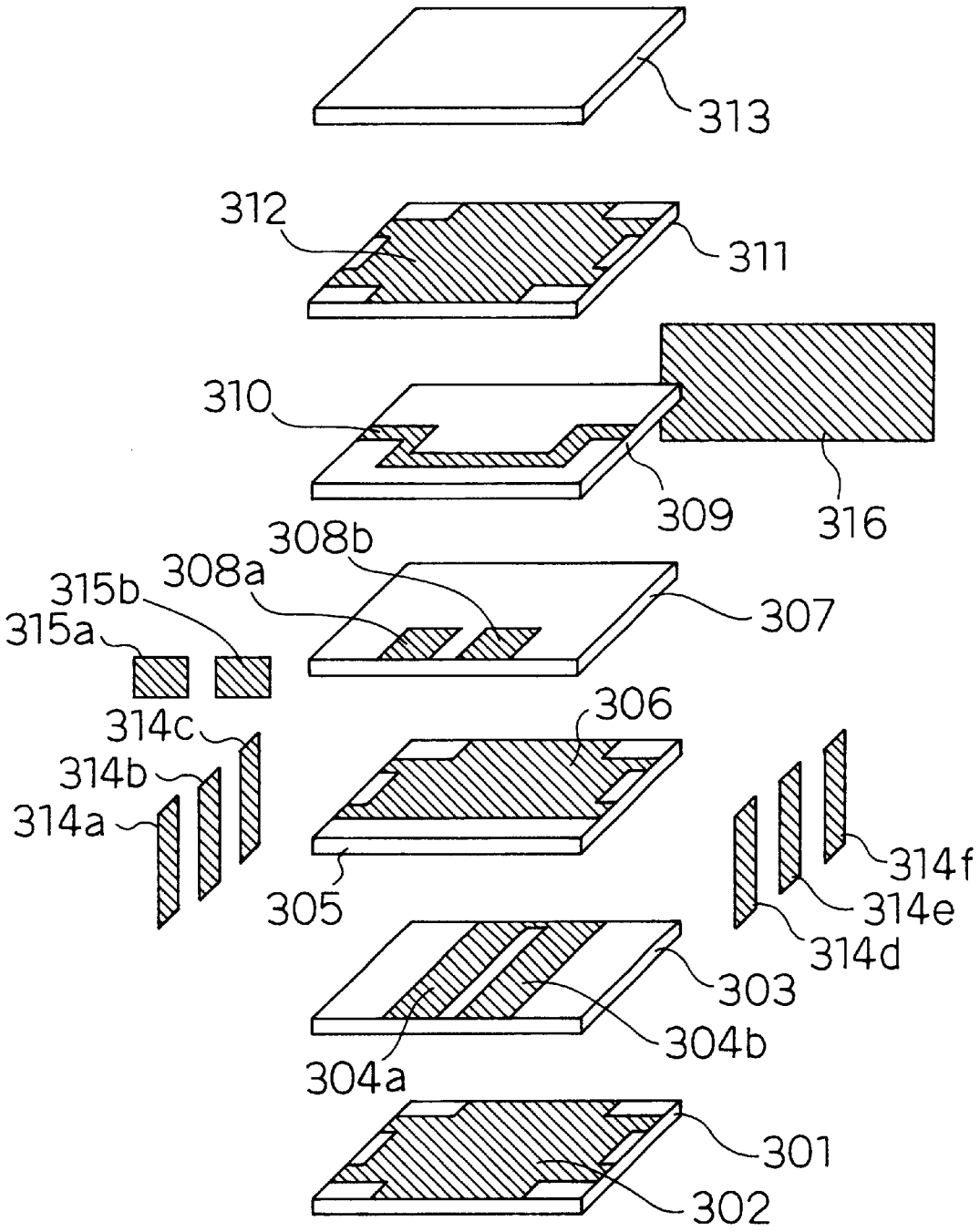
FIG. 15 is an analytic oblique view of a dielectric filter according to a fifth embodiment of the present invention.

FIG. 15 is an analytic oblique view of the structure of the dielectric filter according to a fifth embodiment of the present invention. In FIG. 15, the dielectric filter according to the present embodiment has a first shield electrode 302 for a first dielectric layer 301, second dielectric layer 303 is provided on the top surface of the first shield electrode 302, a first resonator electrodes 304*a*, 304*b* above the second dielectric 303, a third dielectric layer 305 above the resonator electrodes 304*a* and 304*b*, a third dielectric layer 305 above the first resonator electrodes 304*a* and 304*b*, a third shield electrode 306 on the top surface of the third dielectric layer 305, a fourth dielectric layer 307 above the third shield electrode 306, second resonator electrodes 308*a* and 308*b* on the top surface of the fourth dielectric layer 307, a fifth dielectric layer 309 above the second resonator electrodes 308*a* and 308*b*, a transmission line electrode 310 having input/output terminals at both ends on the top surface of the fifth dielectric layer 309, a sixth dielectric layer 311 above the transmission line electrode 310, a second shield electrode 312 on the top surface of the sixth dielectric layer 311, and a seventh dielectric layer 313 above the second shield electrode 312.

Furthermore, six side electrodes 314 are provided on the sides of the dielectric configured by layering the first to seventh dielectric layers, one end of the transmission line electrode 310 is connected to the side electrode 314*b*, and another end of the transmission line electrode 310 is connected to the side electrode 314*e*. Additionally, the first shield electrode 302, the resonator electrodes 304*a* and 304*b*, the second shield electrode 306, the third shield electrode 312, and a side electrode 316 are connected and grounded. In addition, third resonator electrodes 315*a* and 315*b* are formed on one side of the layered structure, and the third resonator electrodes 315*a* and 315*b* are connected to one end of the first resonator electrodes 304*a* and 304*b* and one end of the second resonator electrodes 308*a* and 308*b*. Side electrodes are formed on both ends of the two opposing sides of the layered structure, and are connected to the first, second, and third shield electrodes.

According to the present embodiment with the above mentioned configuration, the dielectric filter has a ¼ wavelength resonator provided with the second resonator electrodes 308*a* and 308*b* having an open end. As in the second embodiment, although the line length of the portion connected to the central point of the overlapping portion between the resonator electrode 308 and the transmission line electrode 310, which are adjacent to each other, is shorter than ¼ of the wavelength corresponding to the resonance frequency of the resonator, it functions as a filter forming a band rejection characteristic around the resonance frequency of the resonator.

Furthermore, according to the present embodiment, an unnecessary electromagnetic field coupling can be reduced between the first resonator electrodes 304*a* and 304*b* and the transmission line electrode 310 by forming the first resonator electrodes 304*a* and 304*b* not opposite the transmission line electrode 310, thereby realizing an easily designed dielectric filter.

According to the above mentioned embodiment, the dielectric filter using a ¼ wavelength resonator having a resonator electrode whose one end is short circuited, and another end is open. However, a similar effect can be obtained with a dielectric filter using a½ wavelength resonator both ends of which are open or short circuited.

Furthermore, the above mentioned present embodiment has two resonator electrodes, but a similar effect can be obtained with three or more resonator electrodes.

Additionally, although there are various methods of forming the transmission line electrodes, capacitors, and resonators using parallel planes, strip lines, etc. according to the present embodiment, the present invention is not limited to these detail applications.

Furthermore, the present invention is not limited to the details of the available materials for the dielectric such as Bi type dielectric ceramics, etc.

Sixth Embodiment

Figure 16:
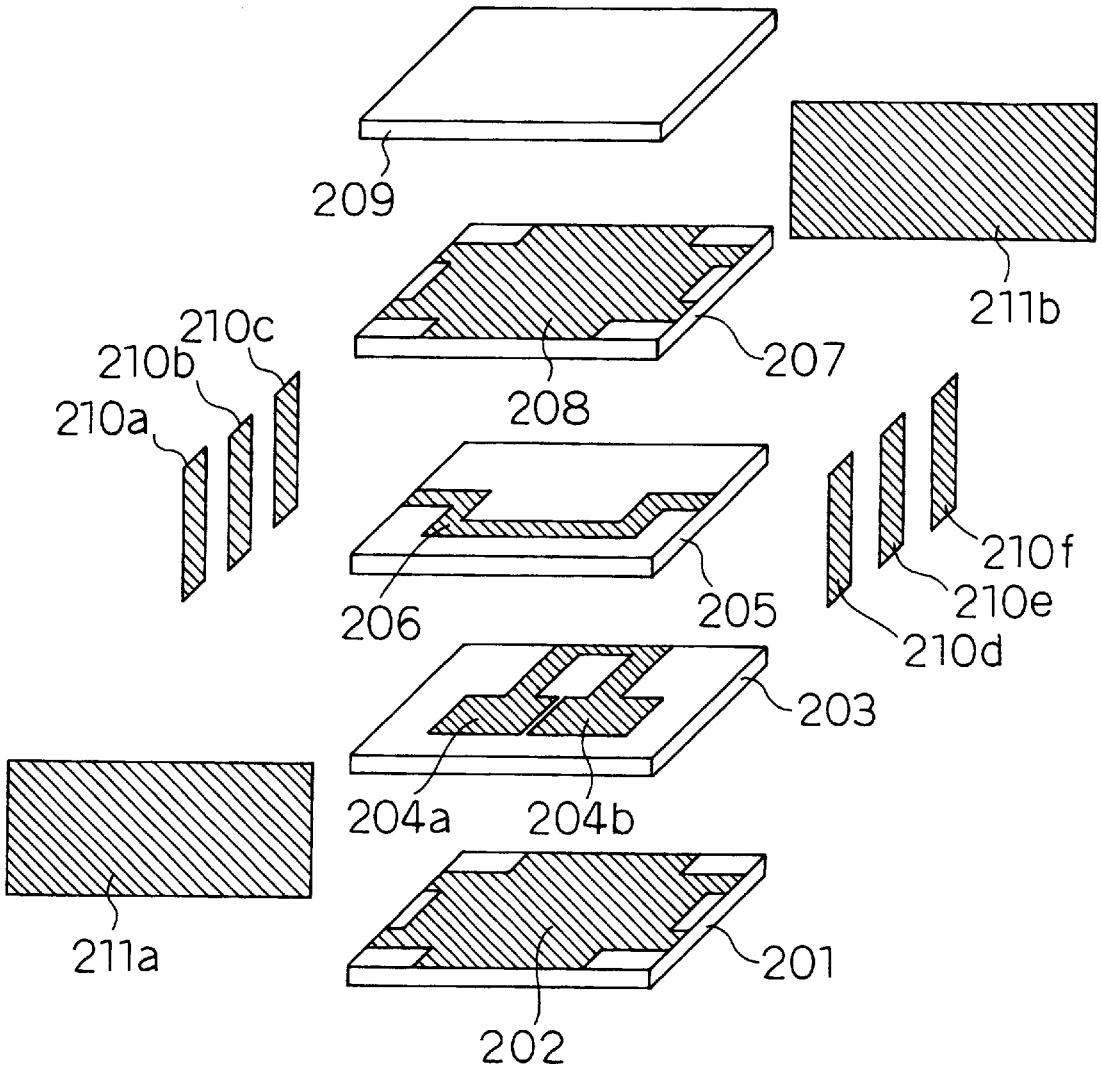
FIG. 16 is an analytic oblique view of a dielectric filter according to a sixth embodiment of the present invention.

FIG. 16 is an analytic oblique view of the structure of the dielectric filter according to a sixth embodiment of the present invention. Since the present embodiment is basically the same as the second embodiment in structure, corresponding units are assigned the same numbers, and the detailed explanation is omitted here.

With the above mentioned configuration, in addition to the effect as the dielectric filter according to the second embodiment, as shown in FIG. 16, the resonance frequency can be reduced with out a long resonator electrode by setting the resonator electrodes 204*a* and 204*b* provided on the top surface of the second dielectric layer 203 with the line width broaden halfway from the short circuit end to the open end. Since the length of the resonator electrode can be shortened, a smaller dielectric filter can be realized.

According to the above mentioned embodiment, the dielectric filter using a ¼ wavelength resonator having a resonator electrode whose one end is short circuited, and another end is open. However, a similar effect can be obtained with a dielectric filter using a ½ wavelength resonator both ends of which are open or short circuited.

Furthermore, the above mentioned present embodiment has two resonator electrodes, but a similar effect can be obtained with three or more resonator electrodes.

Additionally, although there are various methods of forming the transmission line electrodes, capacitors, and resonators using parallel planes, strip lines, etc. according to the present embodiment, the present invention is not limited to these detail applications.

Furthermore, the present invention is not limited to the details of the available materials for the dielectric such as Bi type dielectric ceramics, etc.

Seventh Embodiment

Figure 17:
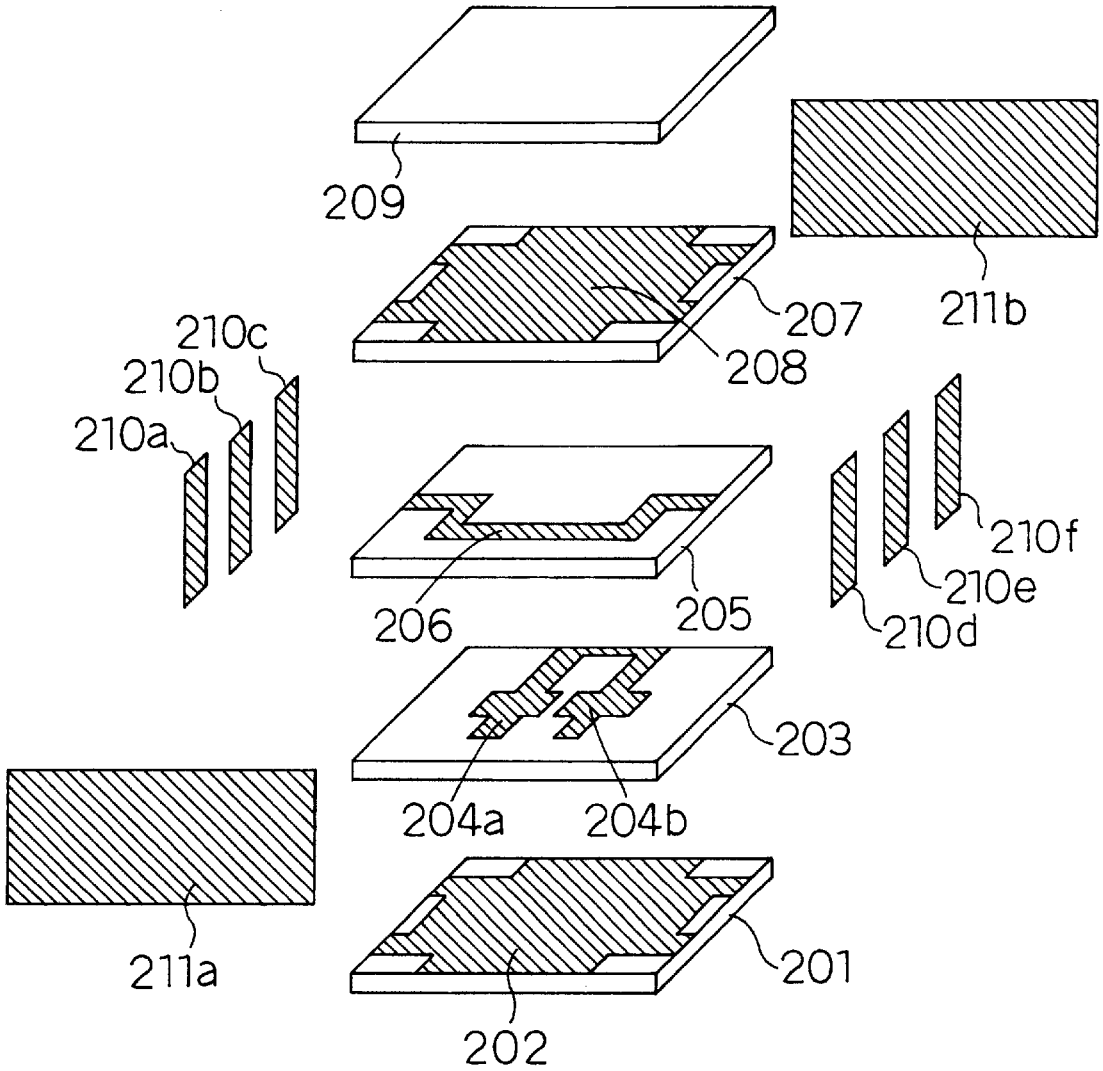
FIG. 17 is an analytic oblique view of a dielectric filter according to a seventh embodiment of the present invention.

FIG. 17 is an analytic oblique view of the structure of the dielectric filter according to a seventh embodiment of the present invention. Since the present embodiment is basically the same as the second embodiment in structure, corresponding units are assigned the same numbers, and the detailed explanation is omitted here.

In FIG. 17, the widths of the resonator electrodes 204*a* and 204*b* provided on the top surface of the second dielectric layer 203 are broadened; only at the central portion.

With the above mentioned configuration, in addition to the effect as a dielectric filter according to the second embodiment, a conductor loss can be reduced more effectively than the constant width line, and the Q value of the resonator electrode can be improved, thereby realizing a low loss filter.

According to the above mentioned embodiment, the dielectric filter using a ¼ wavelength resonator having a resonator electrode whose one end is short circuited, and another end is open. However, a similar effect can be obtained with a dielectric filter using a ½ wavelength resonator both ends of which are open or short circuited.

Furthermore, the above mentioned present embodiment has two resonator electrodes, but a similar effect can be obtained with three or more resonator electrodes.

Additionally, although there are various methods of forming the transmission line electrodes, capacitors, and resonators using parallel planes, strip lines, etc. according to the present embodiment, the present invention is not limited to these detail applications.

Furthermore, the present invention is not limited to the details of the available materials for the dielectric such as Bi type dielectric ceramics, etc.

Furthermore, the above mentioned each embodiment of the present invention has five dielectics in which the transmission electrodes and the resonator electrodes are laminated, the present invention is not limited to this composition. For example, the present invention can be realized by having a composition that at least one dielectrics having transmission line electrodes and resonator electrodes on both surface.

Using the dielectric filter described in each of the above. mentioned embodiments as a antenna duplexer, a low loss antenna duplexer can be realized, a low loss filter corresponding to a cross band can be realized by attenuating a cross band frequency. At this time, the dielectric filter according to the present embodiment can be used as either transmission filter or reception filter, or as a transmission/reception filter.

Therefore, using the dielectric filter described in each of the above mentioned embodiments for a communications appliance, a low-loss and high-efficiency communications appliance can be realized.

As described above, according to the dielectric filter described in each of the above mentioned embodiments of the present invention, the line length of a transmission line connecting resonators can be shortened with zigzag pattern and unnecessary application of a transmission line removed, thereby providing a low loss filter.

Furthermore, since the dielectric filter according to the present invention has a layered structure obtained by piling up a dielectric sheet and an electrode layer baking them in a body, it is possible to offer a small-size, thin-size and low cost filter.

Furthermore, since a part of a resonators are mounted on a layered structure, the structure can be easily adjusted, and the resonance frequency can be adjusted by trimming an adjusting electrode using a luter, etc. Therefore, the differences in thickness of a dielectric sheet, specific inductive capacity, and electrode pattern can be absorbed, there by providing a filter with a higher yield in mass production.

In addition, since an adjusting electrode is provided on a layered structure and connected to an input/output terminal electrode, a filter with which impedance matching can be easily performed can be provided.

Furthermore, by forming a part of resonators not opposite a transmission line, the unnecessary electromagnetic field coupling generated between the resonators and the transmission line can be reduced. As a result, an easily designed filter can be provided.

Additionally, since the resonance frequency can be reduced using a resonator having a broad line at its open end with out using a long resonator, thereby shortening the length of the resonator and realizing a smaller filter.

Furthermore, by broadening the line at the central portion of a resonator, a conductor loss can be reduced much more than using a constant line width , thereby realizing a low loss filter.

Eighth Embodiment

Figure 18:
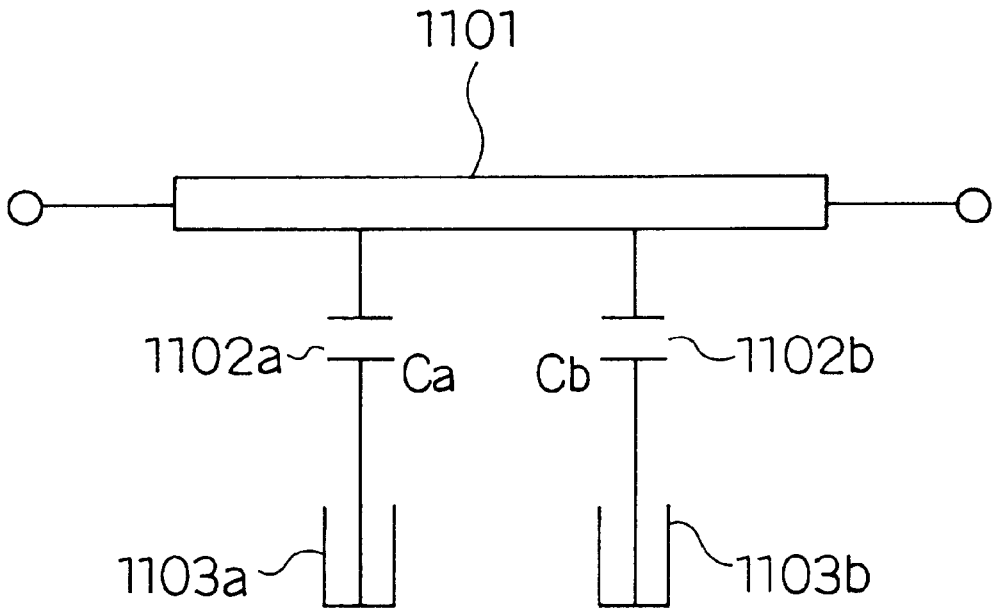
FIG. 18 shows a circuit of the filter forming a band rejection characteristic according to an eighth embodiment of the present invention.

FIG. 18 shows a circuit of the filter according to an eighth embodiment of the present invention. In FIG. 18, a filter forming a band rejection characteristic around the resonance frequency of a resonator comprises a transmission line 1101 having input/output terminals at both ends, and two resonators 1103*a* and 1103*b* connected through capacitors 1102*a* and 1103*b* respectively.

Assuming that the capacity of the capacitor 1102*a* is Ca, and the capacity of the capacitor 1102*b* is Cb, the capacities are set to satisfy Ca<Cb.

With the above mentioned configuration, the operations of the filter are described below.

Since the capacitors 1102*a* and 1102*b* are serially connected to the resonators 1103*a* and 1103*b* respectively, they function as two attenuation poles indicating a large amount of attenuation at the resonance frequencies of the resonators 1103*a* and 1103*b*.

Figure 19:
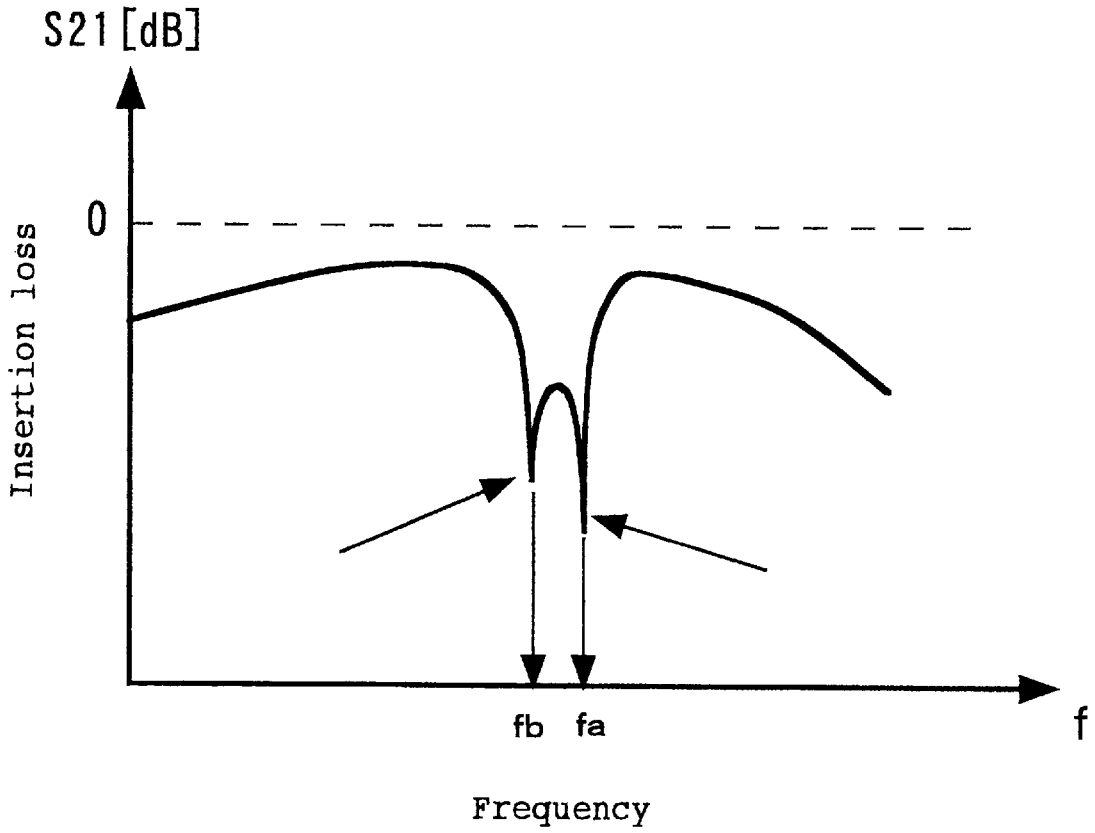
FIG. 19 shows a frequency characteristic showing the pass characteristic (S21) of the filter forming a band rejection characteristic of the circuit shown in FIG. 1.

FIG. 19 shows a pass characteristic (S21) of the filter forming a band rejection characteristic corresponding to the circuit shown in FIG. 18. Since the capacity value of the capacitor is set on the above mentioned conditions, a broad reject ion band of a filter forming a band rejection characteristic can be realized by setting the frequency fb of the attenuation pole formed by the capacitor 1102*b* and the resonator 1103*b* lower than the frequency fa of the attenuation pole formed by the capacitor 1102*a* and the resonator 1103*a*.

According to the present embodiment, two resonators are used, but a similar effect can be obtained with three or more resonators according to the present invention.

Although various methods are used to form the resonators, transmission lines and capacitors according to the present embodiment, the present invention is not limited to these details.

Ninth Embodiment

Figure 20:
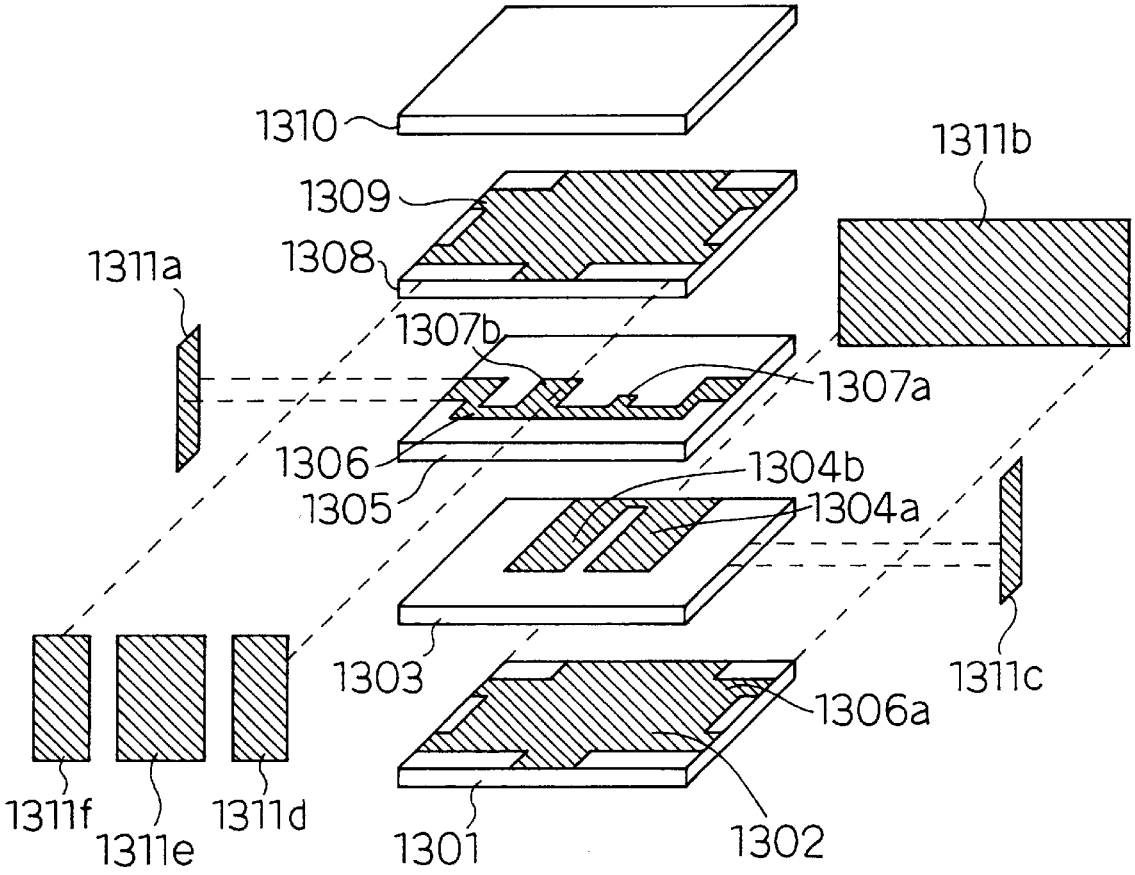
FIG. 20 is an oblique view of a filter forming a band rejection characteristic according to a ninth embodiment of th e present invention.

FIG. 20 is an analytic oblique view of the dielectric filter having a single layered structure according to a ninth embodiment of the present invention.

In FIG. 20, a first shield electrode 1302 is provided on the top surface of a first dielectric layer 1301, a second dielectric layer 1303 is layered above the first shield electrode 1302, resonator electrodes 1304*a* and 1304*b* whose one end is open are provided on the top surface of the second dielectric layer 1303, a tehird dielectric layer 1305 is layered above the resonator electrode 1304*a*, 1304*b*, a transmission line electrode 1306 and capacitor electrodes 1307*a* and 1307*b* are provided on the top surface of the third dielectric layer, 1305, a fourth dielectric layer 1308 is layered above the transmission line electrode 1306 and the capacitor electrodes 1307*a* and 1307*b*, a second shield electrode 1309 is provided on the top surface of the fourth dielectric layer 1308, a fifth dielectric layer 1310 is layered above the second shield electrode 1309, and six side electrodes 1311 are provided on the sides of the dielectrics. One end of the transmission line electrode 1306 is connected to the side electrode 1311*a*. The first shield electrode 1302, the resonator electrodes 1304*a* and 1304*b*, the second shield electrode, and a side electrode 1311*b* are connected and grounded. The other end of the transmission line electrode 1306 is connected to the side electrode 1311*c*. The resonator electrode 1304*a* is connected to a side electrode 1311*d*. The first shield electrode 1302, the second shield electrode 1310, and a side electrode 1311*e* are connected and grounded. The resonator electrode 1304*b* is connected to a side electrode 1311*f*. These internal and external electrodes are made of metal having high conductivity such as silver, gold, copper, etc., and an electrode pattern is printed or plated.

The transmission line electrode 1306, the capacitor electrodes 1307*a* and 1307*b* are connected on the top surface of the third dielectric layer 1305, the resonator electrode 1304*a* and the capacitor electrode 1307*a*, and the resonator electrode 1304*b* and the capacitor electrode 1307*b* are arranged with a part of them above and below th rough the third dielectric layer 1305. Assuming that the area of the over lapping between the resonator electrode 1304*a* and the capacitor electrode 1307*a* is defined as Sa, and the area of the overlapping between the resonator electrode 1304*b* and the capacitor electrode 1307*b* is defined as Sb, they are set to satisfy Sa<Sb.

The operations of the above mentioned filter forming a band rejection characteristic are described below.

The operations of the filter according to the present embodiment are basically the same as those of the filter described in the eighth embodiment. Therefore, the detailed explanation is omitted here.

Since the resonator electrodes 1304*a* and 1304*b* are grounded th rough the side electrode 1311*b*, a ¼ wavelength resonator is formed, and two parallel plane capacitors are formed opposite the open ends of the capacitor electrodes 1307*a* and 1307*b* and the resonator electrodes 1304*a* and 1304*b*. As a result, they function as attenuation pole forming capacities. Therefore, they are two attenuation poles with a large amount of attenuation around the resonance frequencies of the resonator electrodes 1304*a* and 1304*b*.

Furthermore, by adjusting the connection position of the transmission line electrode 1306 and the capacitor electrodes 1307*a* and 1307*b*, the transmission line electrode 1306 is divided into three parts, and functions as a coupling element of the distribution constant line between and outside the two resonator electrodes for an attenuation pole. Therefore, the resonator electrodes 1304*a* and 1304*b* are connected in parallel through the capacitor electrodes 1307*a* and 1307*b*, and function as filters forming a band rejection characteristic using the side electrodes 1311*a* and 1311*c* as input/output terminals.

At this time, the frequency characteristic of the filter is similar to that according to the eighth embodiment as shown in FIG. 19.

Figure 21:
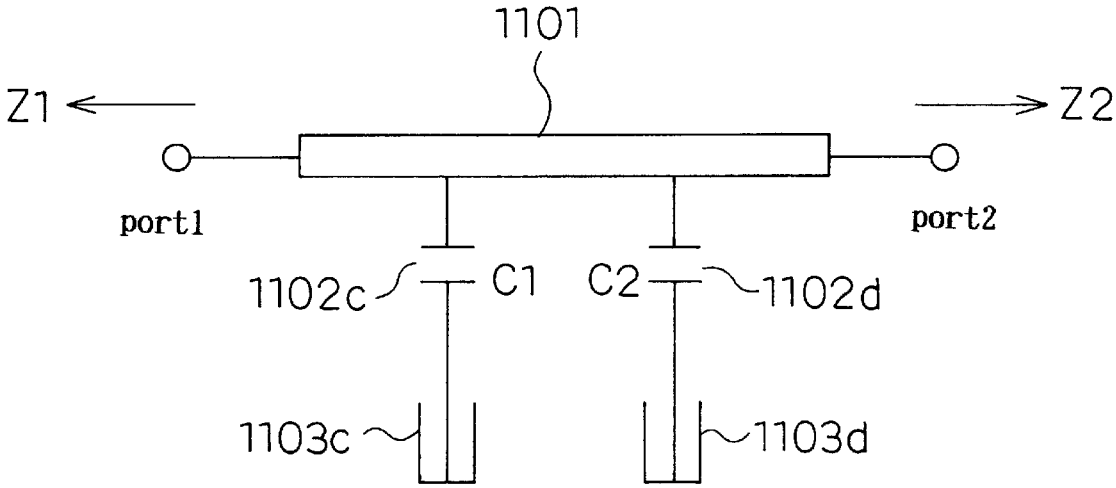
FIG. 21 shows a filter forming a band rejection characteristic according to a ninth embodiment of the present invention.

FIG. 21 shows the circuit of the filter according to the ninth embodiment of the present invention. In FIG. 21, the filter forming a band rejection characteristic around the resonance frequency of the resonator comprises a circuit in which a transmission line 1101 having input/output terminals at both ends and two resonators 1103*c* and 1103*d* are connected through capacitors 1102*c* and 1102*d*. Assuming that the capacity of the capacitor 1102*c* is defined as C1 and the capacity of the capacitor 1102*d* is defined as C2, they are set to satisfy C1<C2.

The basic operations of the filter with the above mentioned configuration are similar to those according to the eighth embodiment. Therefore, the detailed explanation is omitted here.

Figure 22:
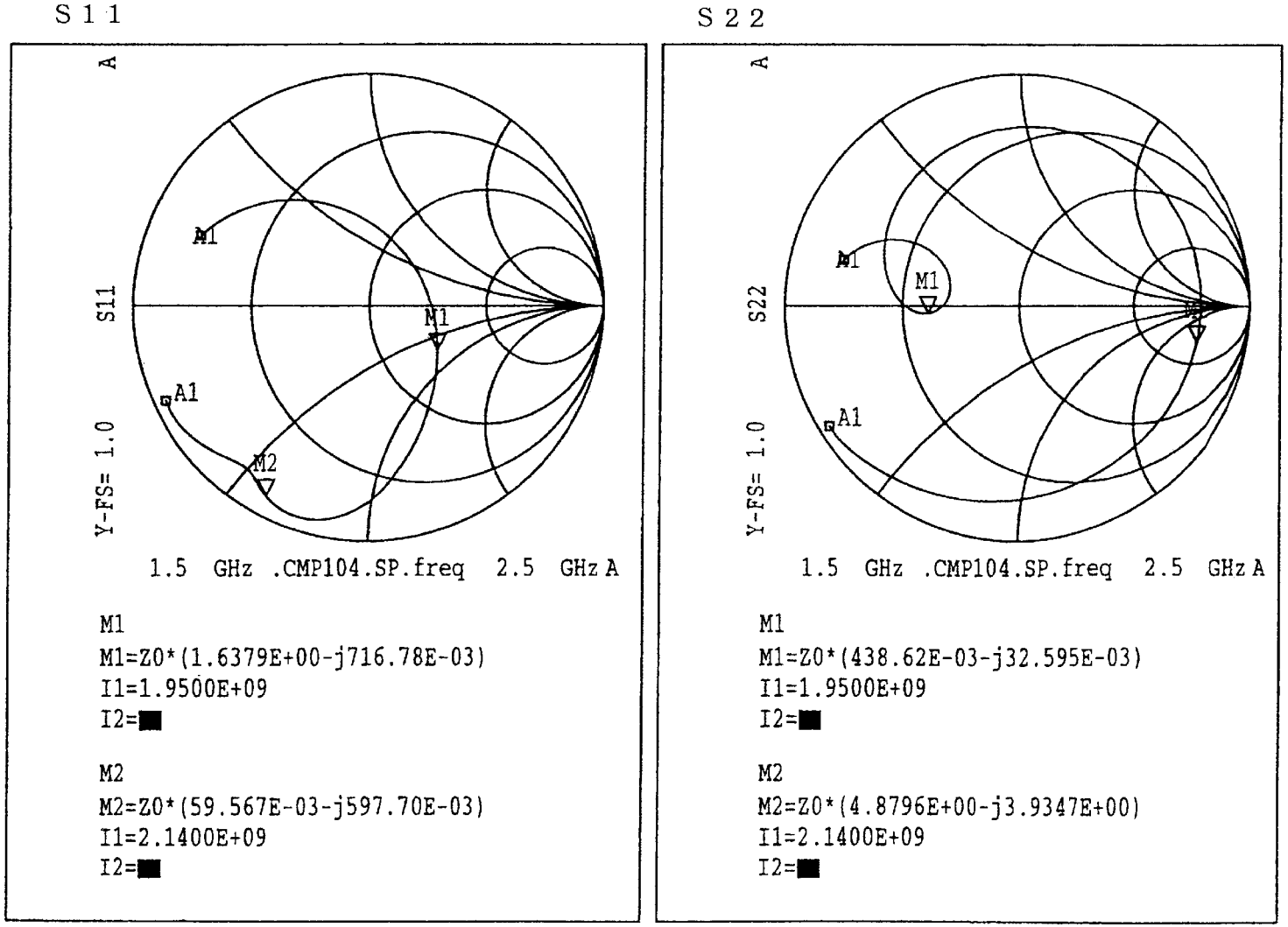
FIG. 22 is a Smith chart of a filter forming a band rejection characteristic according to the second embodiment of the present invention showing the reflection coefficient (S11) at port 1 of the capacity value of a capacitor, and the reflection coefficient (S22) at port 2.

FIG. 22 shows a reflection coefficient (S11) at port 1 and a reflection coefficient (S22) at port 2 of the capacity value of a capacitor under the above mentioned condition. As shown in FIG. 22, the impedance on the port 1 side can be higher while the impedance on the port 2 side can be lower by setting the capacity value of the capacitor 1102*c* smaller than the capacity value of the capacitor 1102*d*.

Therefore, when the filter according to the present invention is installed in a substrate, etc., and when the impedance of the wiring pattern on the port 1 side is high while the impedance of the wiring pattern on the port 2 side is low, the difference in impedance between the ports can be minimized using the filter with the above mentioned configuration, thereby reducing the loss due to the inconsistency at the connection point between the substrate and the filter.

Then, the resonance frequency of a resonator is adjusted to obtain an excellent frequency characteristic. The frequency of the attenuation pole formed by the capacitor 1102*b* and the resonator 1103*b* can be made higher by shortening the resonator 1103*b*.

Figure 24:
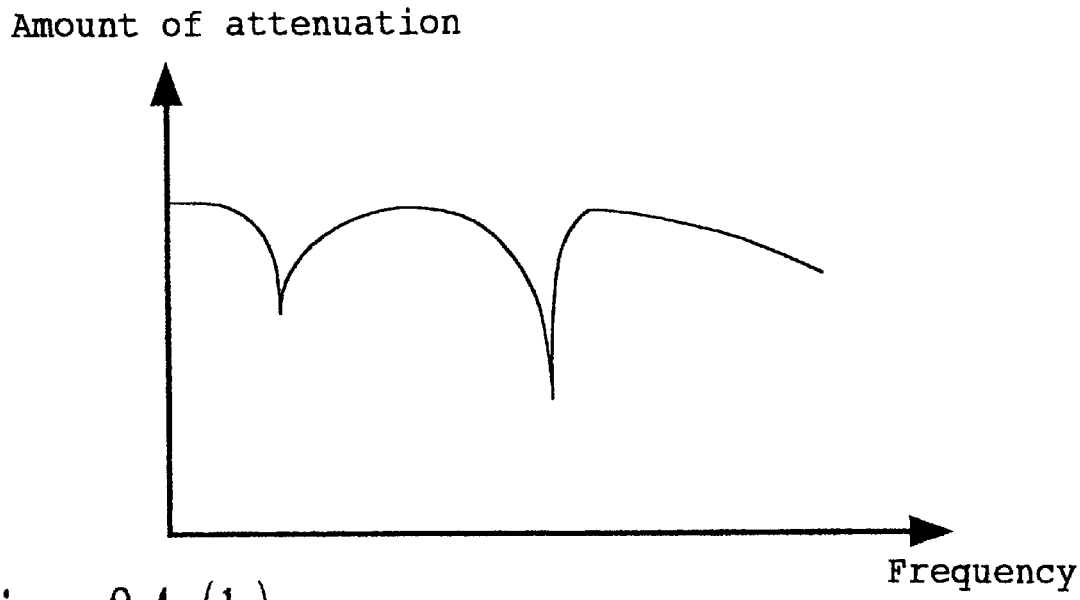
FIG. 24 shows a frequency characteristic of the filter according to the present invention.
Figure 24:
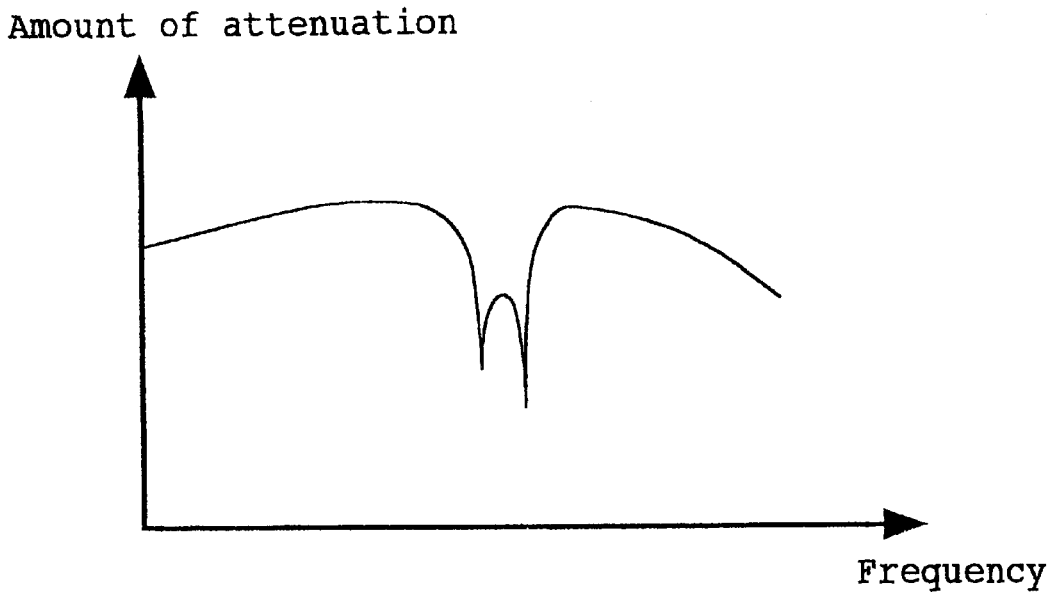
Figure 25:
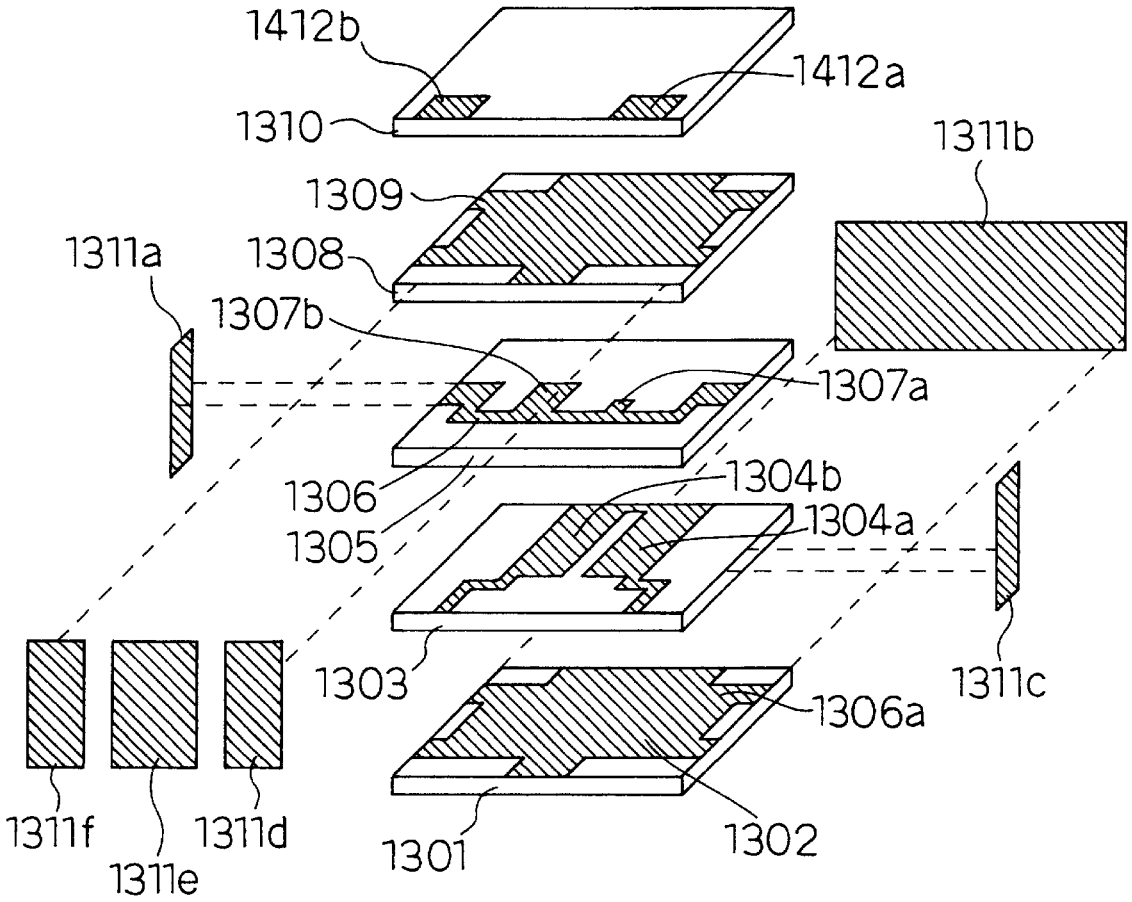
FIG. 25 is an oblique view of a filter forming a band rejection characteristic showing another example according to the tenth embodiment of the present invention.

At this time, if the capacity values of the capacitor 1102*a* and the capacitor 1102*b* are equal to each other as in the conventional technology, the frequencies of the two attenuation poles are also equal to each other, and the frequency of the attenuation pole formed by the capacitor 1102*a* and the resonator 1103*a* is interlockingly made higher because a layered type filter is coupled in electromagnetic field. However, with the configuration according to an embodiment of the present invention, since the capacity values of the capacitor 1102*a* and the capacitor 1103*b* are different from each other, the frequencies of the two attenuation poles are different. As a result, the two attenuation poles are not interlocked, thereby independently moving the attenuation pole formed by the capacitor 1102*b* and the resonator 1103*b*. Therefore, the pass characteristic at th is stage is as shown in FIG. 24(*a*).

Then, the frequency of the attenuation pole formed by the capacitor 1102*a* and the resonator 1103*a* can be made higher by shortening the length of the resonator 1103*a*. Since the capacity of the capacitor is set on the above mentioned conditions, the two attenuation poles are not interlocked, and only the attenuation pole formed by the capacitor 1102*a* and the resonator 1103*a* independently moves. Therefore, the final pass characteristic is as shown in FIG. 24(*b*).

With the above mentioned configuration, the present embodiment functions as a filter forming a band rejection characteristic capable of independently adjusting the frequency of an attenuation pole.

If the thickness of at least one resonator electrode among a plurality of resonator electrodes is different from the thicknesses of other resonator electrodes, then the range of the optimization of the filter design can be extended. Although various methods of forming a transmission line between input/output terminals, a capacitor, and a resonator, the present invention is not limited to the details of these methods.

Tenth Embodiment

Figure 23:
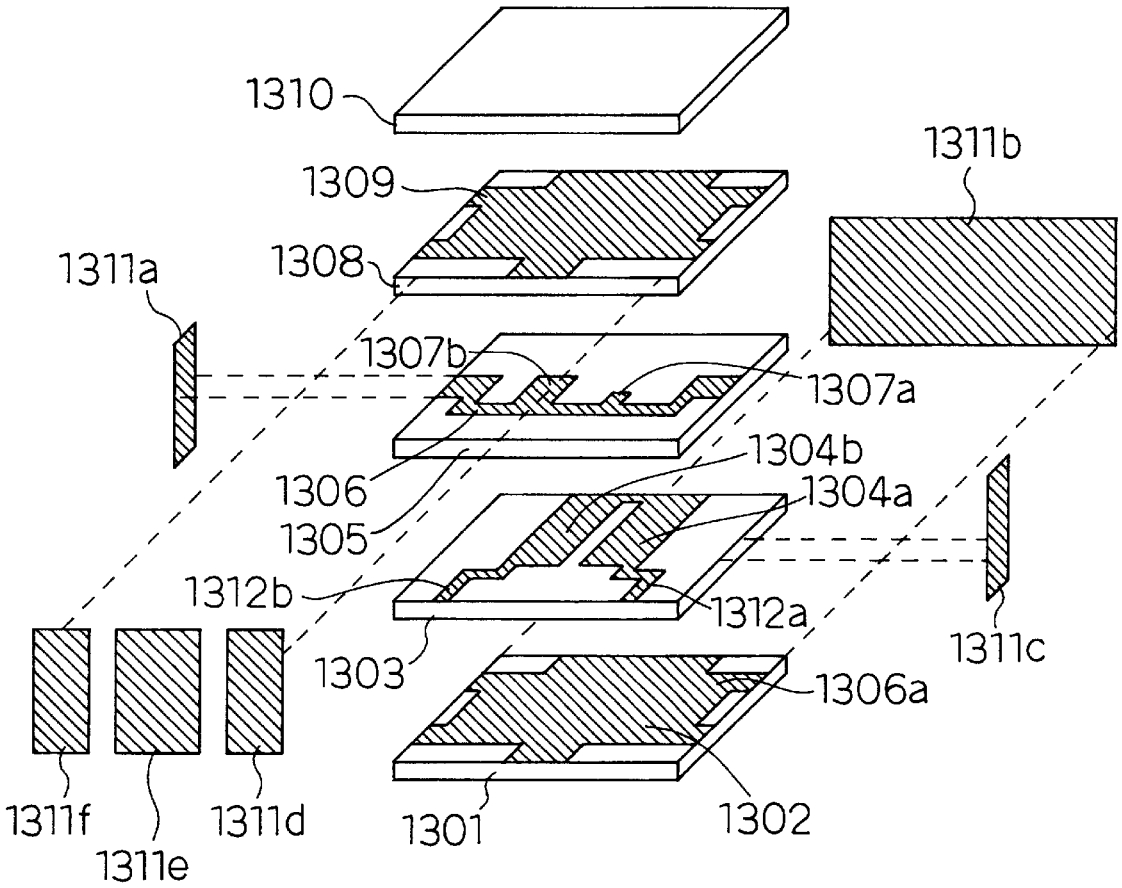
FIG. 23 is an oblique view of a filter forming a band rejection characteristic according to a tenth embodiment of th e present invention.

FIG. 23 is an analytic oblique view of the dielectric filter having a single; layered structure according to a tenth embodiment of the present invention.

Since the present embodiment is basically the same in structure as the ninth embodiment, the corresponding units are assigned the same reference numerals, and the detail explanation is omitted here. According to the present embodiment, a connection unit 1312*a* is provided between the resonator electrode 1304*a* and the side electrode 1311*d*, and a connection unit 1312*b* is provided between the resonator electrode 1304*b* and the side electrode 1311*f*.

Then, the resonance frequency of a resonator is adjusted to obtain an excellent frequency characteristic. Since the side electrodes 1311*d* and 1311*f* can be regarded as a part of the resonator, the resonance frequency can be adjusted by trimming it.

Since the side electrode 1311*d* is connected to the open end of the resonator electrode 1304*a* and the side electrode

1311*f* is connected to the open end of the resonator electrode 1304*b*, they function as load capacitors of the resonator.

Therefore, the frequency of the attenuation pole formed by the resonator electrode 1304*b* and the capacitor electrode 1307*b* can be made higher by obtaining a smaller area by trimming the side electrode 1311*f*, that is, by reducing the load capacitors working on the resonator electrode 1304*b*.

At th is time, when the capacitor formed by the resonator electrode 1304*a* and the capacitor electrode 1307*a*, and the capacitor formed by the resonator electrode 1304*a* and the capacitor electrode 1307*b* have the same capacity values, the frequencies of the two attenuation pole are equal to each other, and the frequency of the attenuation pole formed by the resonator electrode 1304*a* and the capacitor electrode 1307*a* is interlockingly enhanced.

However, with the above mentioned configuration, the areas of the resonator electrode 1304*a* and the resonator electrode 1304*b* are different from each other. Therefore, the frequencies of the two attenuation poles are different from each other and, as a result, the two attenuation poles are not interlocked. Therefore, only the attenuation pole formed by the resonator electrode 1304*b* and the capacitor electrode 1307*b* independently moves. As a result, the pass characteristic at th is stage is as shown in FIG. 24(*a*).

Then, the frequency of the attenuation pole formed by the resonator electrode 1304*a* and the capacitor electrode 1307*a* can be made higher by obtaining a smaller area by trimming the side electrode 1311*d*, that is, by reducing the load capacitors working on the resonator electrode 1304*a*. At th is time, since the area of the capacitor electrode is similarly set on the above mentioned conditions, the two attenuation poles are not interlocked, and only the attenuation pole formed by the resonator electrode 1304*a* and the capacitor electrode 1307*a* independently moves. As a result, the final pass characteristic is as shown in FIG. 24(*b*).

With the above mentioned configuration, the present embodiment functions as a filter forming a band rejection characteristic capable of independently adjusting the frequency of the attenuation pole.

According to the present embodiment, the frequency of the attenuation pole is adjusted by trimming the side electrodes 1311*d* and 1311*f*. It can also be adjusted by providing adjusting electrodes 1412*a* and 1412*b* on the top surface of the fifth dielectric layer 1310, connecting the side electrode 1311*d* with the adjusting electrode 1412*a*, connecting the side electrode 1311*f* with the adjusting electrode 1412*b*, and trimming the adjusting electrodes 1412*a* and 1412*b*. With the present configuration, the adjusting electrodes 1412*a* and 1412*b* are arranged opposite the second shield electrode 1309 through the fifth dielectric layer 1310, thereby forming a parallel plane capacitor functioning as a load capacitor, extending an adjustable frequency range, and more easily obtaining a filter having an excellent frequency characteristic.

The above mentioned adjusting capacitor electrode can be provided on the reverse side of the first dielectric layer 1301, inside the first dielectric layer 1301, or inside the fourth dielectric layer 1308. In addition, there can be a the frequency range can be extended.

There are various methods of forming an electrode according to the present embodiment, but the present invention is not limited to the details of these methods.

Furthermore, there are various dielectrics applicable in the present embodiment, but the present invention is not limited to the details.

Eleventh Embodiment

Figure 26:
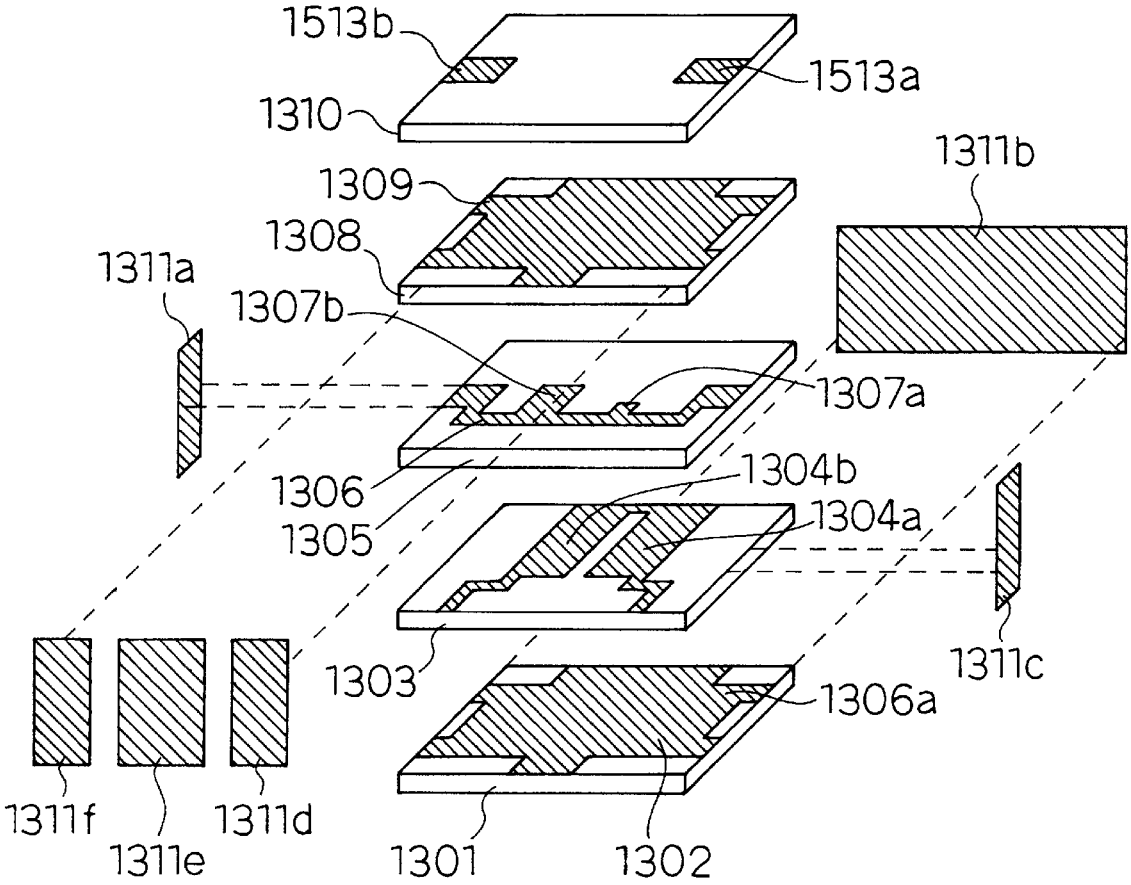
FIG. 26 is an oblique view of a filter forming a band rejection characteristic according to an eleventh embodiment of the present invention.

FIG. 26 shows a filter forming a band rejection characteristic according to an eleventh embodiment of the present invention. Since the present embodiment is basically the same in structure as the second embodiment, the corresponding units are assigned the same reference numerals, and the detailed explanation is omitted here. In FIG. 26, adjusting electrode 1513*a* and 1513*b* are arranged on the top surface of the fifth dielectric layer 1310, the side electrode 1311*a* is connected with the adjusting electrode 1513*a*, and the side electrode 1311*c* is connected with the adjusting electrode 1513*b*.

The operations of the above configured filter are described below.

As described above by referring to the second embodiment, the present embodiment has the resonator electrodes 1304*a* and 1304*b* connected in parallel through the capacitor electrodes 1307*a* and 1307*b*. Therefore, it functions as a filter forming a band rejection characteristic having the side electrode 1311*a* as an input terminal, and the side electrode 1311*c* as an output, terminal, and the side electrodes 1311*d* and 1311*f* are trimmed, thereby obtaining an excellent frequency characteristic as shown in 24(*b*).

To obtain an excellent impedance characteristic, a matching capacity is adjusted. Since the adjusting electrodes 1513*a* and 1513*b* have capacities between the shield electrodes of the filter, and the adjusting electrode 1513*a* is connected to the side electrode 1311*a*, it functions as a matching capacitor at the input terminal. Simultaneously, since the adjusting electrode 1513*b* is connected to the side electrode 1311*c*, it functions as a matching capacitor at the output terminal. Therefore, a filter having impedance matching can be realized by reducing the area of the adjusting electrode 1513*a* by trimming it, that is, reducing the matching capacitors working on the input terminal.

Similarly, a filter having impedance matching can be realized by reducing the area of the adjusting electrode 1513*b* by trimming it.

With the above mentioned configuration, the present embodiment can function as a filter forming a band rejection characteristic capable of adjusting a matching capacity and easily obtaining impedance matching.

Furthermore, according to the above mentioned embodiment, the adjusting capacitor electrode can be provided on the reverse side of the first dielectric layer 1301, inside the first dielectric layer 1301, or inside the fourth dielectric layer 1308. In addition, there can be a plurality of adjusting capacitor electrodes. In th is case, the frequency range can be extended.

There are various methods of forming an electrode according to the present embodiment, but the present invention is not limited to the details of these methods.

Furthermore, there are various dielectrics applicable in the present embodiment, but the present invention is not limited to the details.

Twelfth Embodiment

Figure 27:
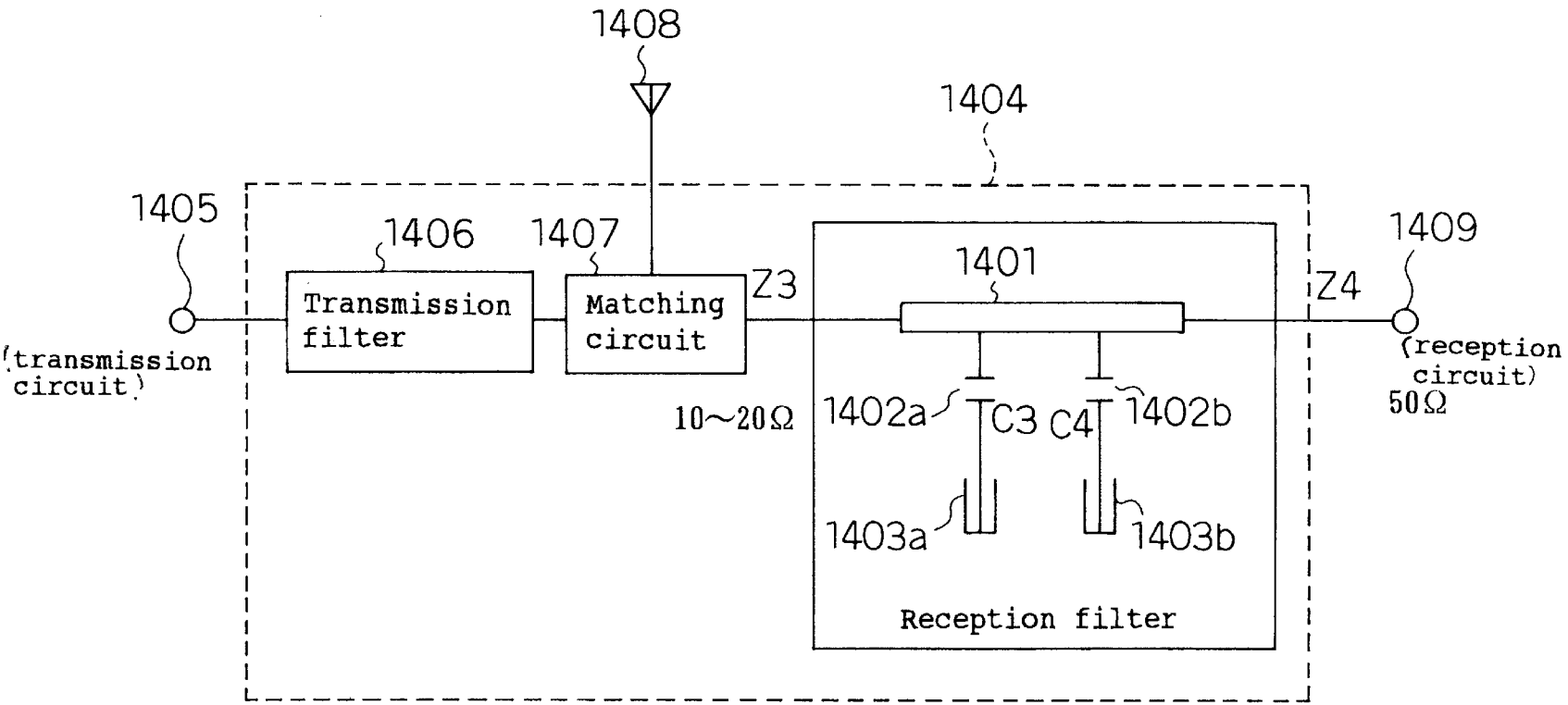
FIG. 27 shows a circuit of a communications appliance according to a twelfth embodiment of the present invention

Described below is a twelfth embodiment of the present invention. A communications appliance such as a portable telephone according to the present embodiment comprises a antenna duplexer 1404, a transmission circuit 1405, and a reception circuit 1409 as shown in FIG. 27. Furthermore, antenna duplexer 1404 comprises a transmission filter 1406, a reception filter 1410, a matching circuit 1407 connected to the transmission filter 1406 and the reception filter 1410, and an antenna 1408.

Furthermore, at least one of the transmission filter 1406 and the reception filter 1410 relates to the present invention from the above mentioned embodiments eighth to eleventh, etc. That is, the filter comprises a transmission line 1401, capacitors 1402*a* and 1402*b*, and resonators 1403*a* and 1403*b*, and the transmission line 1401 has input/output terminals Z3 and Z4 at both ends.

Therefore, although the impedance on the Z3 side is different from the impedance on the Z4 side, the sizes of the capacitors 1402*a* and 1402*b* of the reception filter 1410 are made to correspond to the level of impedance, thereby reducing the loss due to the non-matching of impedance at the connection portions among the matching circuit 1407, reception circuit 1409, and the reception filter 1410. This holds true with the transmission filter 1406.

Thirteenth Embodiment

Figure 28:
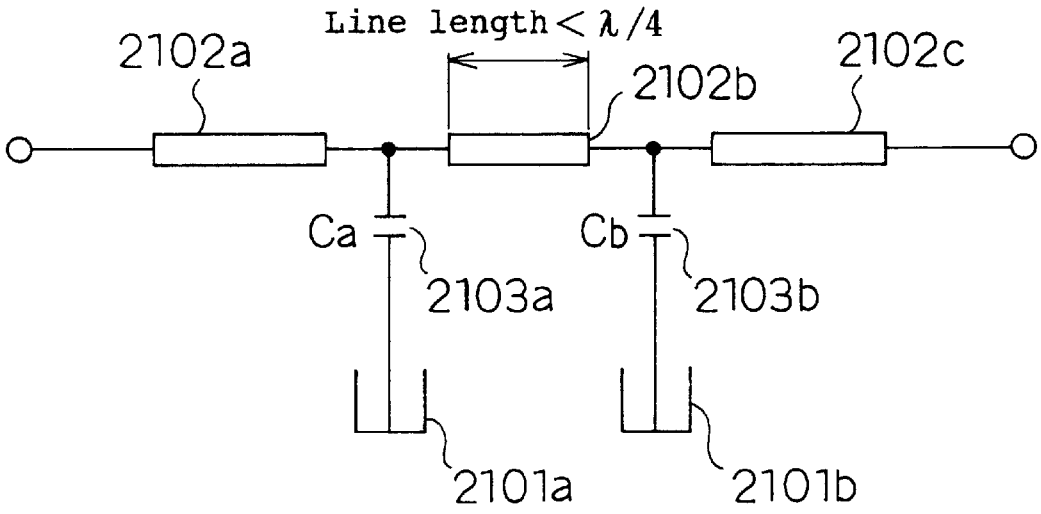
FIG. 28 shows an equivalent circuit of a dielectric filter according to a thirteenth embodiment of the present invention.

FIG. 28 shows the circuit of the filter according to the thirteenth embodiment of the present invention. In FIG. 28, the layered structure filter forming a band rejection characteristic around the resonance frequency of a resonator comprises a circuit in which a transmission line 2101 having input/output terminals at both ends and two resonators 2103*a* and 2103*b* are connected through capacitors 2102*a* and 2102*b* respectively. Since resonators 2101*a* and 2101*b* are connected in parallel to the transmission line 2101 through a capacity, the resonators 2101*a* and 2101*b* function as filters forming an attenuation pole around the resonance frequency, and having a band rejection characteristic. Furthermore, the line length of the transmission line 2102*b* is set shorter than ¼ of the wavelength corresponding to the resonance frequency of the resonator, and the resonators 2101*a* and 2101*b* are coupled in electromagnetic field.

Additionally, assuming that the capacity of the capacitor 2102*a* is defined as Ca, the capacity of the resonator 2101*b* as Cb, the capacities of them are set to satisfy Ca<Cb.

That is, the present embodiment realizes a dielectric filter having the characteristics of the transmission line according to the first embodiment and the characteristic of the capacitor according to the eighth embodiment.

Therefore, according to the present embodiment, by setting a transmission line shorter than the conventional technology, a smaller filter can be realized as in the first embodiment, and simultaneously an extended rejection band of a filter can be realized as in the eighth embodiment.

Another invention is described below according to the embodiment shown in FIG. 29.

Figure 29:
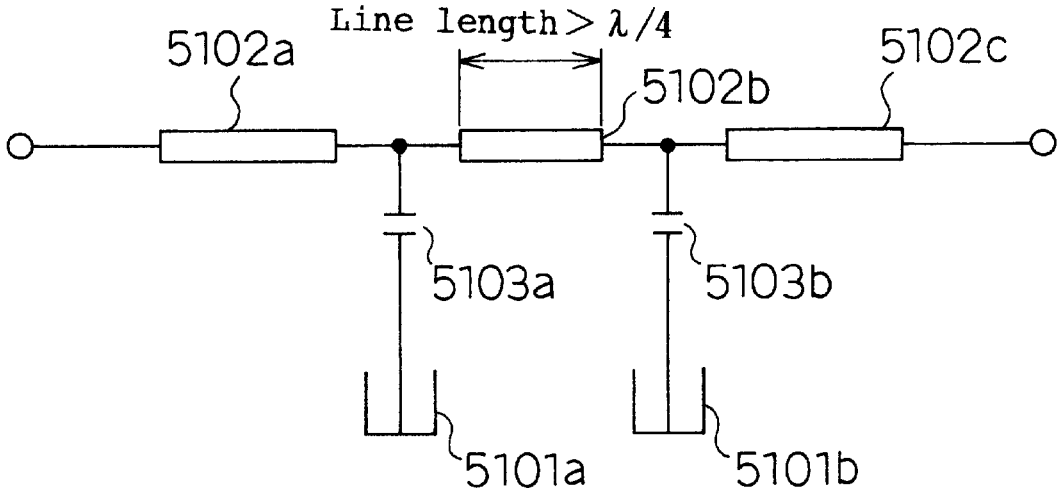
FIG. 29 shows an equivalent circuit of a dielectric filter according to an embodiment of another aspect of the present invention.

In FIG. 29, the layered structure filter forming a band rejection characteristic around the resonance frequency of a resonator comprises a circuit in which a transmission line 5102 having input/output terminals at both ends and two resonators 5101*a* and 510*b* are connected th rough capacitors 5103*a* and 5103*b* respectively.

In FIG. 29, since the resonators 5101*a* and 5101*b* are connected in parallel through a capacity to a transmission line, the resonators 5101*a* and 5101*b* form an attenuation pole around the resonance frequency and function as filters having a band rejection characteristic.

Conventionally, in the filter theory, it is necessary to have infinite impedance at the resonance frequency of a resonator to form a band rejection characteristic. As described above by referring to the first embodiment, this has been attained by setting the length of the transmission line 102*b* b as ¼ of the wavelength corresponding the resonance frequency of a resonator as shown in FIG. 2(*a*), thereby allowing the transmission line 102*b* to function as the parallel resonant circuit 102*b* d shown in the equivalent circuit shown in FIG. 2(*b*).

On the other hand,with the above mentioned configuration, a filter forming a band rejection characteristic around the resonance frequency of a resonator can be realized by coupling in electromagnetic field the resonator 5101*a* with the resonator 5101*b* although the transmission line 5102*b* is set longer than ¼ of the wavelength corresponding to the resonance frequency of a resonator as shown in FIG. 3(*c*). That is, in the conventional filter theory, it is necessary to set the length of a transmission line as ¼ of the resonance frequency of a resonator to have infinite impedance. However, according to the present invention, as shown in the equivalent circuit shown in FIG. 3(*d*), the parallel resonant circuit 5102 is configured by a transmission line and a resonator coupled in electromagnetic field, thereby obtaining the same effect as the conventional technology even using a transmission line longer than ¼ of the resonance frequency of a resonator.

The filter according to the present embodiment obtains the above mentioned effect as long as the resonator 5101*a* and the resonator 5101*b* are coupled in electromagnetic field as described below.

Figure 30:
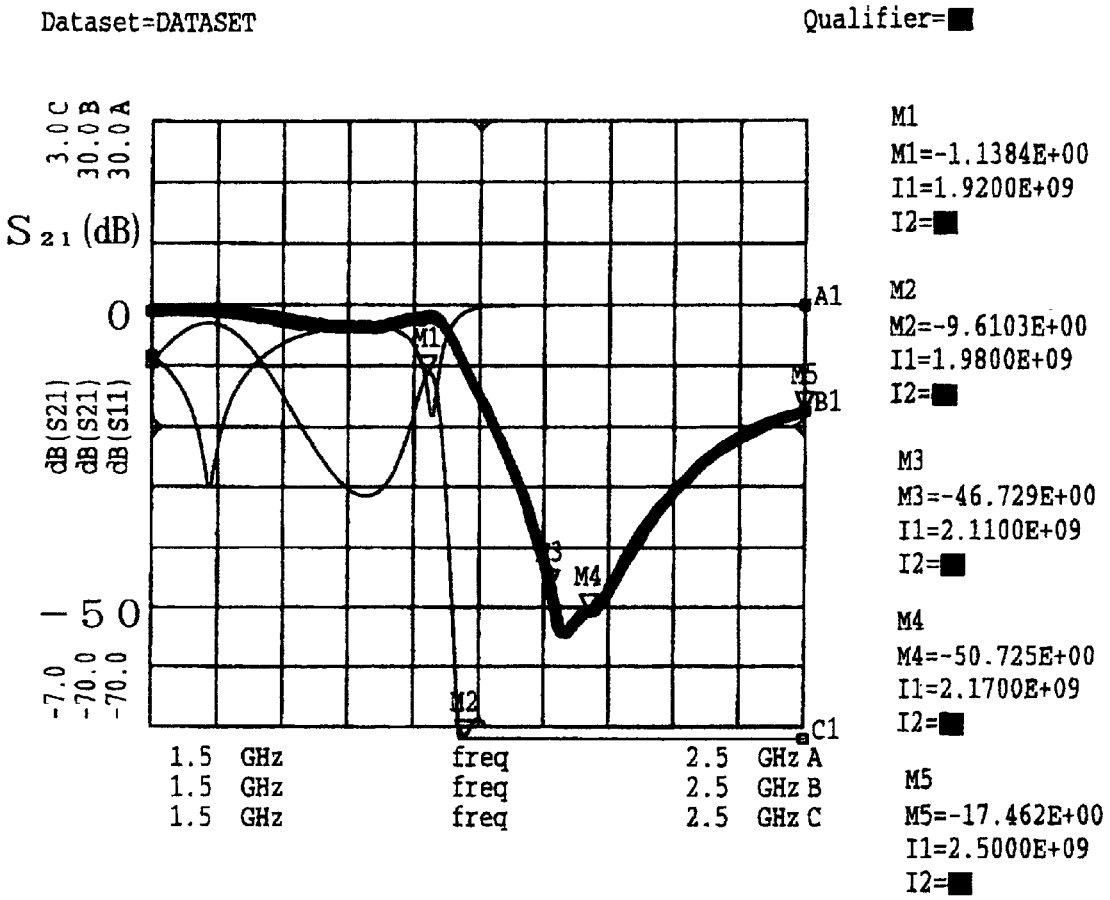
FIG. 30 shows a frequency characteristic (simulation value) of a dielectric filter according to an embodiment of another aspect of the present invention.
Figure 31:
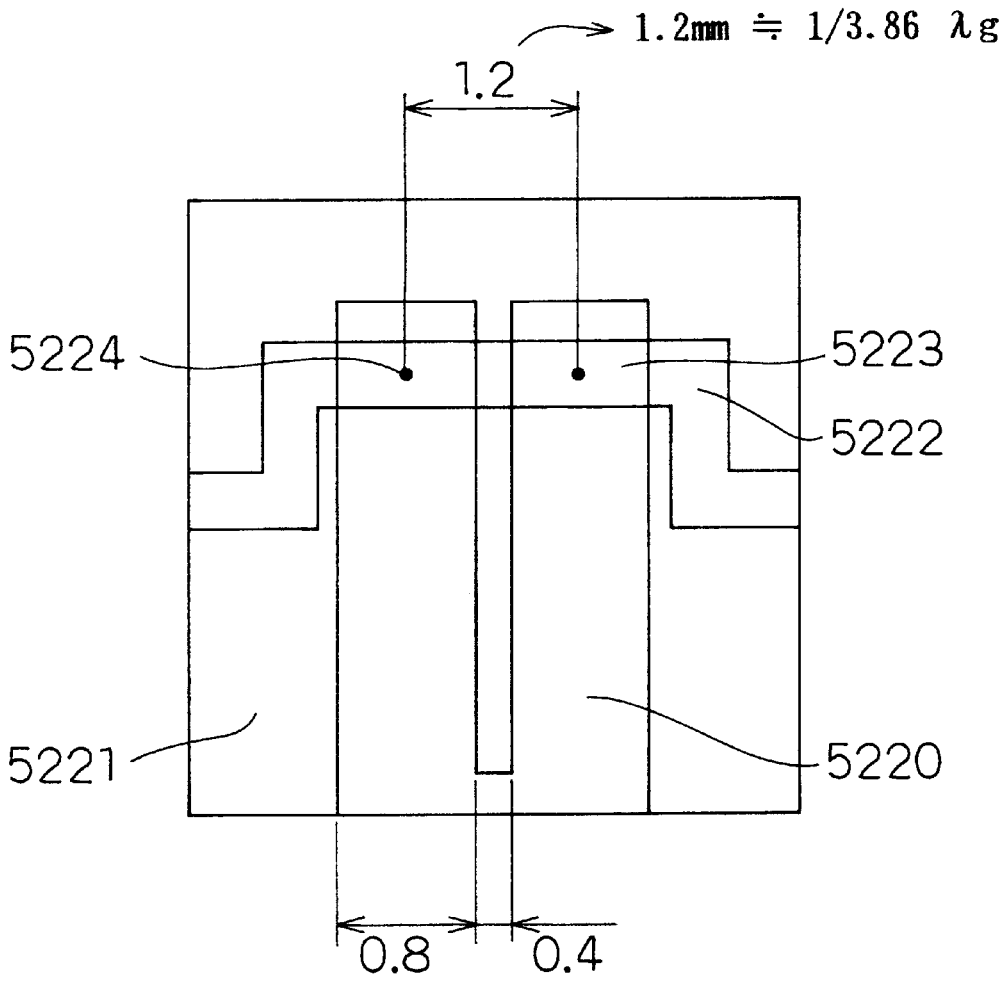
FIG. 31 is an analytic projection view of a dielectric filter according to an embodiment of another aspect of the present invention.
Figure 32:
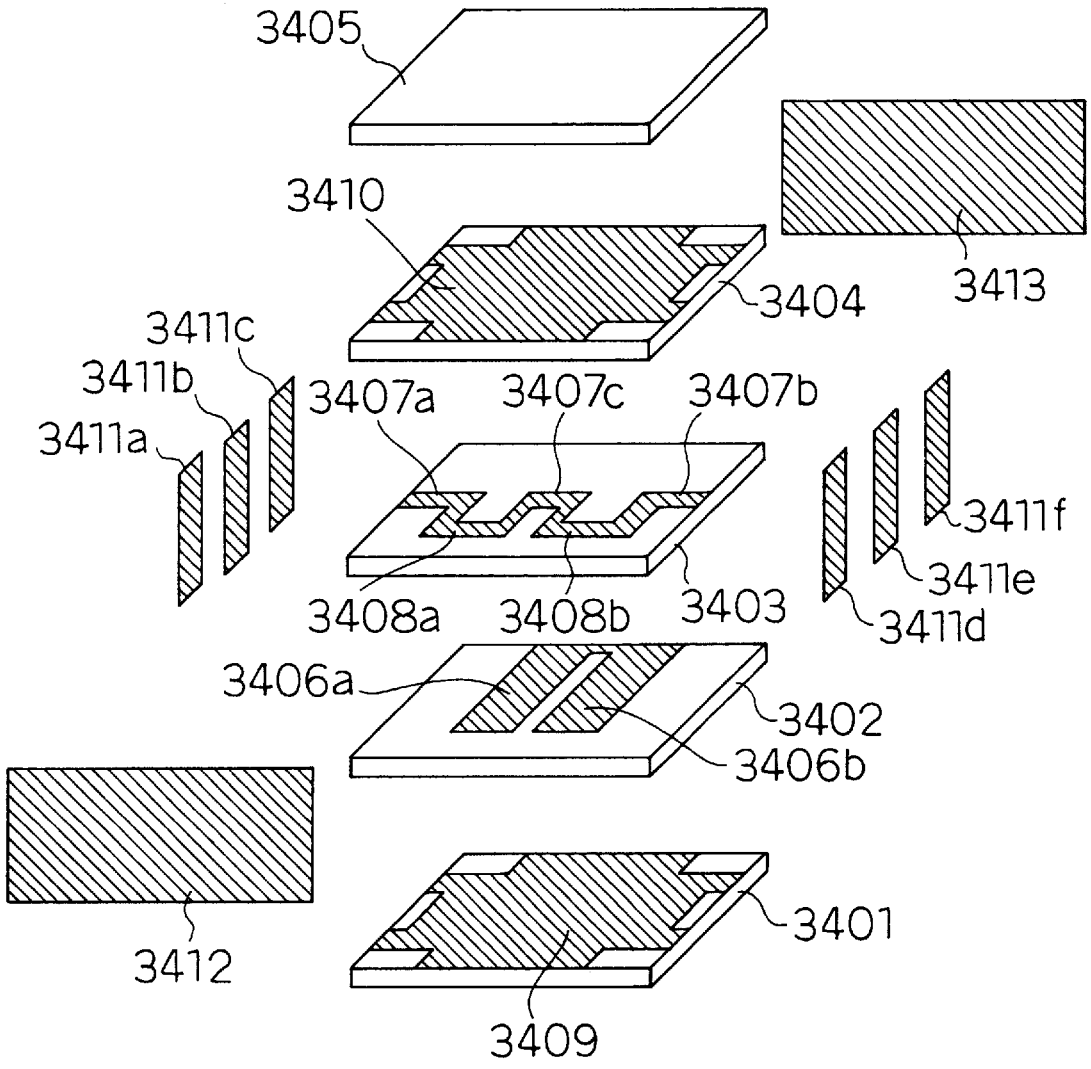
FIG. 32 is an analytic oblique view of the conventional dielectric filter.
Figure 33:
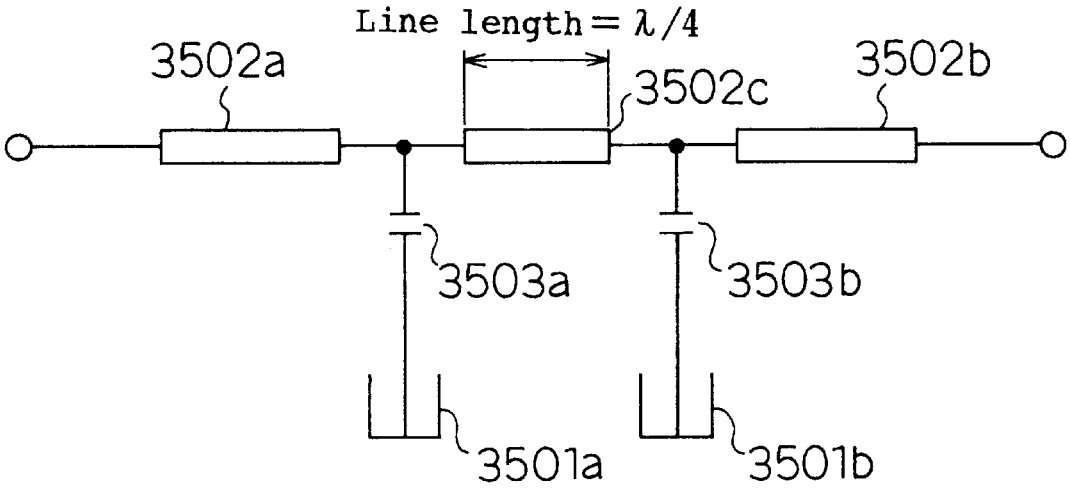
FIG. 33 is an equivalent circuit of the conventional dielectric filter.
Figure 34:
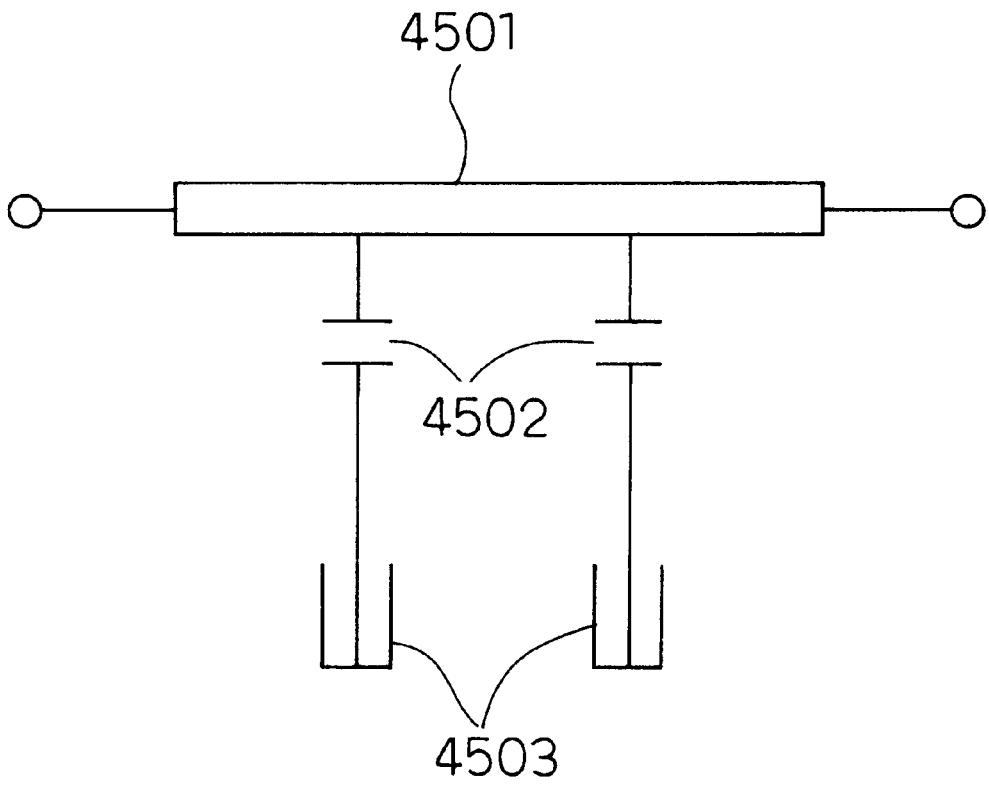
FIG. 34 shows an equivalent circuit of a conventional filter forming a band rejection characteristic around a resonance frequency of a resonator.
Figure 35:
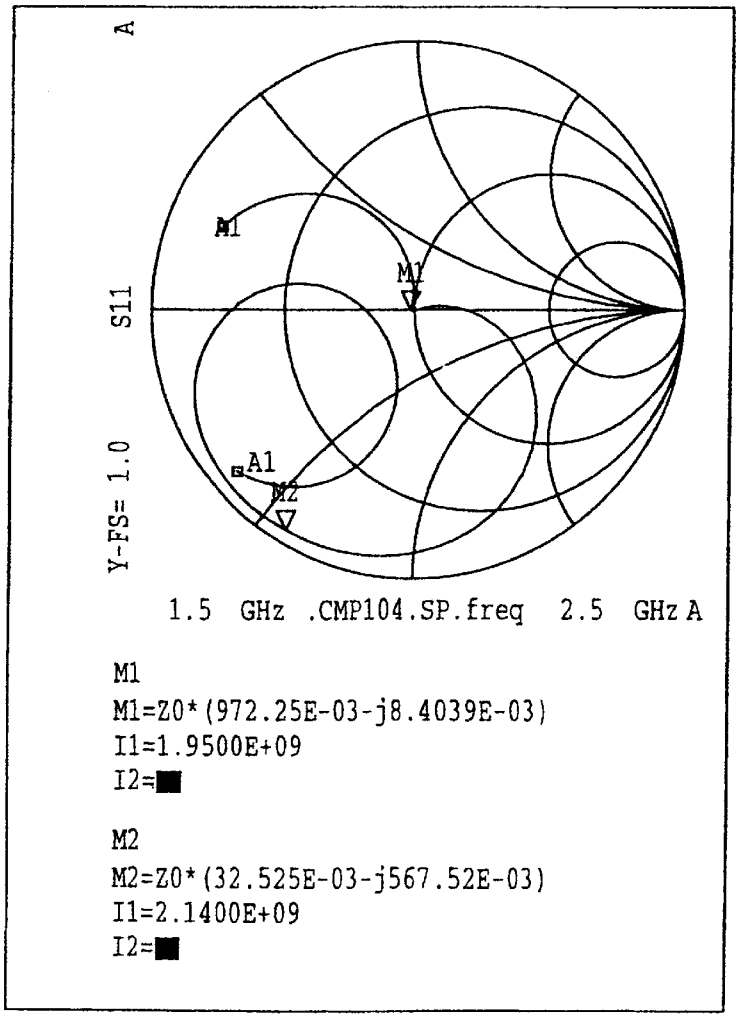
FIG. 35 is a Smith chart showing the feature according to a conventional filter.
Figure 35:
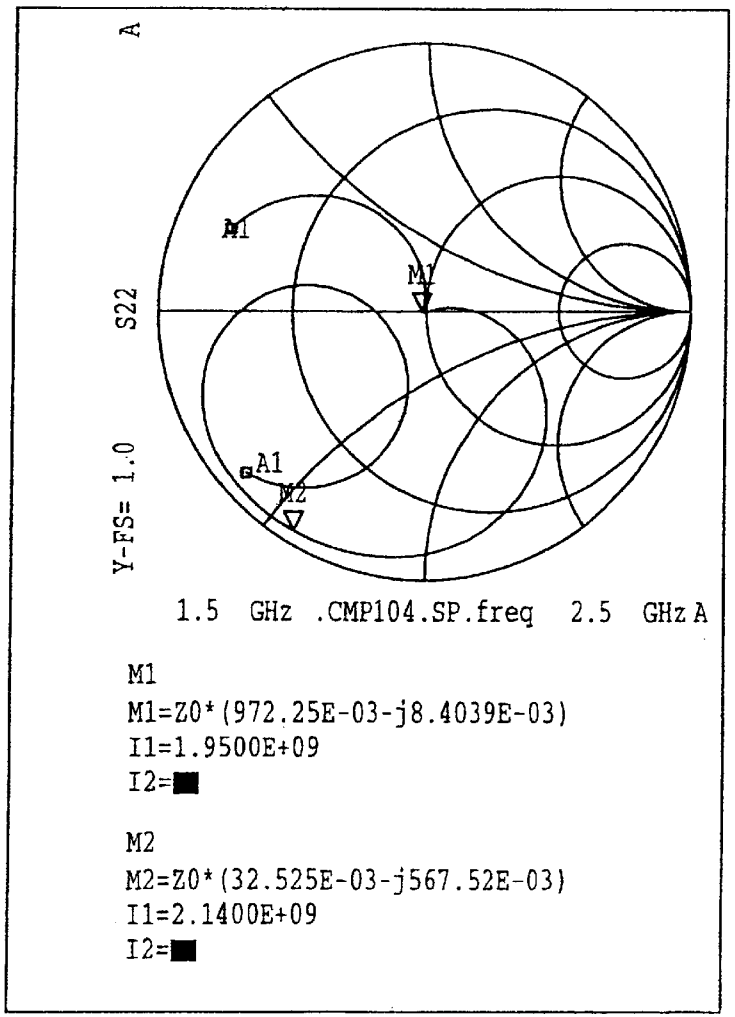
Figure 36:
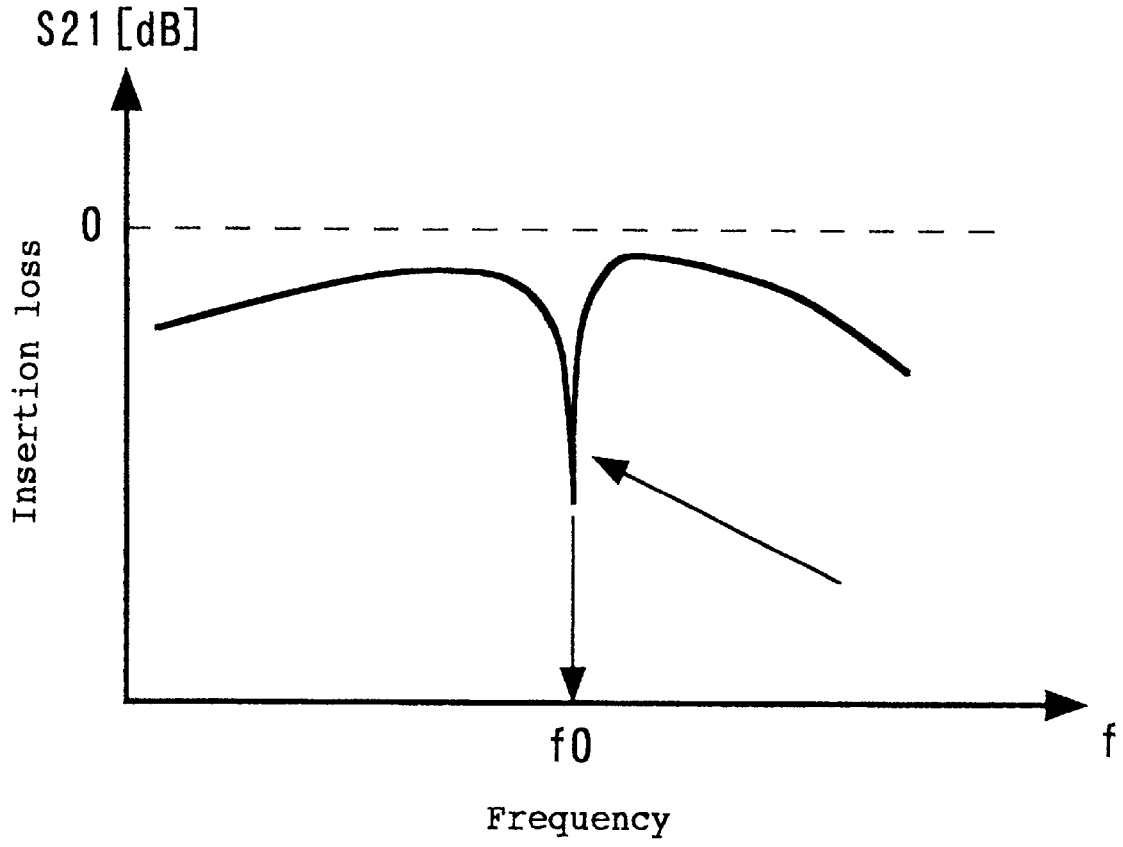
FIG. 36 shows a frequency characteristic according to th e conventional technology.

FIG. 30 is a graph showing the frequency characteristic of a trial dielectric filter according to the present embodiment. The trial filter is obtained by layering a dielectric sheet having a specific inductive capacity of 58 and a dielectric layer mainly made of silver. The layered structure of the filter is 5.0 mm depth, 4.5 mm width, and 2.0 mm height. The wavelength corresponding to the resonance frequency of a resonator in a dielectric is 20 mm, and the length of a transmission line 5222 provided between central points 2224 of overlapping portions 5223 between a resonator electrode 5220 and the transmission line 5222 is 5.1 mm, which is about $1/3.86$ of the wavelength. The frequency area evaluating the operations of a filter is 1.5 GHz to 2.5 GHz. However, the operation area itself of the filter is larger th an th is area.

As a result of the experimentation according to the example with the above mentioned configuration, the filter forming the band rejection characteristic around the resonance frequency of a resonator according to the present embodiment indicates a low loss at a pass band frequency (in the range equal to or lower than 2.0 GHz), and a large amount of attenuation at a rejection band frequency as shown in FIG. 30.

According to the present embodiment, the two resonators 5101*a* and 5101*b* are used, but the same effect can be obtained with three or more resonators according to the present invention.

Although there are various methods of forming a resonator, a transmission line, and a capacitor, but the present invention is not limited to the details of the methods. As clearly described above, the present invention can provide a filter, comprising a plurality of resonators, capable of forming a band rejection characteristic around the resonance frequencies of the resonators by setting the transmission line formed between resonators shorter than ¼ of the wavelength corresponding to the resonance frequency of the resonators.

Furthermore, according to the present invention, a filter having an excellent band rejection characteristic around the resonance frequency of a resonator can be realized with a simple configuration, and a filter having an excellent characteristic in impedance matching, etc. can be realized as a antenna duplexer, and, a transmission filter or a reception filter of a communications appliance.

Additionally, according to the present invention, the present invention can provide a filter, comprising a plurality of resonators, capable of forming a band rejection characteristic around the resonance frequencies of the resonators by setting the transmission line formed between resonators longer than ¼ of the wavelength corresponding to the resonance frequency of the resonators.

What is claimed is:

1. A dielectric filter, comprising:

a plurality of resonators; and at least one transmission line provided among said plurality of resonators, wherein a band rejection characteristic is formed around a resonance frequency of said resonator, and a line length of said transmission line is shorter than 1/15 of a wavelength corresponding to the resonance frequency of said resonator.

2. The dielectric filter according to claim 1, wherein said plurality of resonators are coupled in electromagnetic field.

3. The dielectric filter according to claim 2, wherein:

a dielectric sheet and an electrode layer are layered and co-fired into one layered structure; and said resonator and said transmission line are realized as an entire or a part of said electrode layer.

4. The dielectric filter, comprising:

a plurality of resonators; and at least one transmission line provided among said plurality of resonators, wherein a band rejection characteristic is formed around a resonance frequency of said resonator, and a line length of said transmission line is shorter than ¼ of a wavelength corresponding to the resonance frequency of said resonator;

said plurality of resonators are coupled in an electromagnetic field;

a dielectric sheet and an electrode layer are layered and co-fired into one layered structure;

said resonator and said transmission line are realized as an entire or a part of said electrode layer;

said dielectric sheet comprises at least one dielectric layer;

said electrode layer comprises:

a plurality of resonator electrodes provided on one primary surface of said dielectric layer; and a transmission line electrode, provided on another primary surface of said dielectric layer, whose ends are input/output terminals;

said resonator electrode operates as said resonator; and in a projection drawing where said resonator electrode and said transmission line electrode are viewed from a direction perpendicular to a surface of said dielectric layer, there are a plurality of overlapping portions of said transmission line electrode and adjacent said resonator electrodes, such portion of said transmission electrode that is positioned between each central point of said overlapping portions, corresponds to said transmission line, and a part of said transmission line electrode is positioned along central points of an overlapping portion of said resonator electrodes and said transmission line electrode, and corresponds to said transmission line.

5. The dielectric filter according to claim 4, wherein said dielectric sheet comprises at least five dielectric layers from a first dielectric layer to a fifth dielectric layer; and said electrode layer comprises at least:

a first shield electrode provided between said first dielectric layer and said second dielectric layer;

a plurality of resonator electrodes provided between said second dielectric layer and said third dielectric layer;

a transmission line electrode which has input/output terminals at both ends and is provided between said third dielectric layer and said fourth dielectric layer; and a second shield electrode provided between said fourth dielectric layer and said fifth dielectric layer.

* * * * *